US008534664B2

(12) United States Patent
Yamamoto

(10) Patent No.: US 8,534,664 B2
(45) Date of Patent: Sep. 17, 2013

(54) IMAGE FORMING APPARATUS AND FEED MECHANISM

(75) Inventor: Kiyonori Yamamoto, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 57 days.

(21) Appl. No.: 13/190,133

(22) Filed: Jul. 25, 2011

(65) Prior Publication Data

US 2012/0025450 A1 Feb. 2, 2012

(30) Foreign Application Priority Data

Aug. 2, 2010 (JP) ..... 2010-173844

(51) Int. Cl.
*B65H 3/52* (2006.01)

(52) U.S. Cl.
USPC ..... 271/124; 271/110; 271/121

(58) Field of Classification Search
USPC ..... 271/110, 121–127, 167
See application file for complete search history.

(56) References Cited

U.S. PATENT DOCUMENTS

| | | | | |
|---|---|---|---|---|
| 7,104,539 | B2 * | 9/2006 | Shimoyama | 271/167 |
| 8,052,139 | B1 * | 11/2011 | Su et al. | 271/117 |
| 8,113,505 | B2 * | 2/2012 | Lee | 271/167 |
| 8,196,918 | B2 * | 6/2012 | Arimura et al. | 271/124 |
| 2004/0188918 | A1 * | 9/2004 | Morimoto et al. | 271/121 |
| 2008/0303204 | A1 * | 12/2008 | Lee et al. | 271/121 |
| 2012/0261878 | A1 * | 10/2012 | Lai | 271/227 |

FOREIGN PATENT DOCUMENTS

| | | | |
|---|---|---|---|
| JP | 2001-242563 | A | 9/2001 |
| JP | 2007-022762 | A | 2/2007 |
| JP | 2009-038787 | A | 2/2009 |

* cited by examiner

*Primary Examiner* — Kaitlin Joerger
*Assistant Examiner* — Ernesto Suarez

(57) ABSTRACT

An image forming apparatus, comprising: a feed roller; a separation unit; a position detection part includes: a detection member that can move to a retracted position, and a detector which detects that a image formation target material is disposed at the feed position or the feed setup position in a case of having detected that the detection member is at the retracted position; and a restricting member that is disposed at a restricting position that restricts the detection member from moving from the initial position to the retracted position by abutting the detection member, in a detached state in which the separation unit is detached from the mounting part.

11 Claims, 13 Drawing Sheets

IMAGE FORMING APPARATUS AND FEED MECHANISM

This application is based on and claims the benefit of priority from Japanese Patent Application No. 2010-173844, filed on 2 Aug. 2010, the content of which is incorporated herein by reference.

BACKGROUND OF THE INVENTION

1. Field of the Invention

The present invention relates to an image forming apparatus having a feed mechanism that feeds image formation target materials. In addition, the present invention relates to a feed mechanism that feeds image formation target materials.

2. Related Art

Conventionally, image forming apparatuses such as copy machines include a housing in which an image forming portion is disposed to be housed, and a feed mechanism (device) that feeds paper (image formation target materials) into the housing.

The feed mechanism of an image forming apparatus typically includes a feed roller that feeds paper (image formation target material) to inside of the housing, and a pad unit (separation unit) that has a separation pad member (separation member) disposed so as to oppose the feed roller and insert, therebetween and the feed roller, paper. The feed roller and pad unit of the feed mechanism are consumable items that tend to wear and deteriorate. As a result, worn or deteriorated consumable items such as the feed roller and pad unit in the feed mechanism are replaced by a user with a new feed roller or pad unit.

In this operation, a user may forget to install the new feed roller or pad unit into the feed mechanism when replacing the feed roller or pad unit. In a case of the feed mechanism being operated in a state in which the user has forgotten to install the new feed roller or pad unit, a malfunction will occur such as a paper jam in the feed mechanism.

To address this, an image forming apparatus has been proposed that includes a feed roller detection means, for example, as a technology to suppress forgetting to install a new feed roller in the feed mechanism.

However, with such a feed mechanism, the feed roller detection means is not a means for detecting the presence of the pad unit including the separation pad member.

In addition, the pad unit including the separation pad member is covered by the feed roller in the state installed in the feed mechanism, and thus it may be difficult to determine whether it is installed or not from outside.

Furthermore, even in a state in which the unit including the separation pad member is not installed in the feed mechanism, paper may be disposed at a position that can be fed by the feed roller. In such a case, there has been a problem in that a severe paper jam occurs from a plurality of sheets of paper being fed at one time when the feed roller is rotationally driven. Moreover, there has been a problem in that a failure will occur in the feed mechanism or the image forming apparatus equipped with this feed mechanism due to such a severe paper jam.

SUMMARY OF THE INVENTION

The present invention has an object of providing an image forming apparatus having a feed mechanism that can suppress malfunctions that may arise in a state in which a separation unit including a separation member is not installed.

In addition, the present invention has an object of providing a feed mechanism that can suppress malfunctions that may arise in a state in which the separation unit is not installed.

The present invention relates to an image forming apparatus, comprising: an image forming portion; a housing in which the image forming portion is disposed to be housed; a placement portion on which at least one image formation target material can be placed; a feed roller that is disposed to oppose an upper surface of at least one image formation target material placed on the placement portion to be disposed at a predetermined feed position, and feeds a topmost image formation target among the at least one image formation target material to inside of the housing; a supply feed path in which image formation target materials are fed; a separation unit that is disposed at a predetermined mounting part so as to configure a portion of the supply feed path and is detachable relative to the mounting part, and includes a separation member that is disposed to oppose the feed roller on a more downstream side in a feed direction in which the image formation target materials are fed than the feed position, and is disposed so as to insert, therebetween and the feed roller, the image formation target material; a position detection part can detect that at least one image formation target material is disposed at a predetermined position on the placement portion, and includes: a detection member that can move between an initial position that is a position at which a leading end of the at least one image formation target material is abutted in a case of the at least one image formation target material being moved from the predetermined position to the feed position or a feed setup position that is in the vicinity of the feed position and is for moving image formation target material to the feed position by a predetermined lift member, and a retracted position retracted from the placement portion in a state in which the at least one image formation target material is disposed at the feed position or the feed setup position, and a detector which detects that the at least one image formation target material is disposed at the feed position or the feed setup position in a case of having detected that the detection member is at the retracted position; and a restricting member that is disposed at a stored position opposing the detection member to interpose the separation unit therewith, in a mounted state in which the separation unit is mounted to the mounting part, and is disposed at a restricting position that restricts the detection member from moving from the initial position to the retracted position by abutting the detection member, in a detached state in which the separation unit is detached from the mounting part.

In addition, the present invention relates to a feed mechanism, comprising: a placement portion on which at least one sheet material can be placed; a feed roller that is disposed to oppose an upper surface of at least one sheet material placed on the placement portion to be disposed at a predetermined feed position, and feeds a topmost sheet among the at least one sheet material in a predetermined feed direction; a supply feed path in which sheet materials are fed; a separation unit that is disposed at a predetermined mounting part so as to configure a portion of the supply feed path and is detachable relative to the mounting part, and includes a separation member that is disposed to oppose the feed roller on a more downstream side in a feed direction in which the sheet materials are fed than the feed position, and is disposed so as to insert, therebetween and the feed roller, the sheet material; a detection member that is disposed in order to detect that at least one sheet material is disposed on the placement portion, and can move between an initial position that is a position at which a leading end of the at least one sheet material is abutted in a case of the at least one sheet material being moved from the predetermined position to the feed position or a feed setup position that is in the vicinity of the feed position and is for moving sheet material to the feed position by a predetermined lift member, and a retracted position retracted from the placement portion, in a state in which the at least one sheet material is disposed at the feed position or the feed setup position; and a restricting member that is disposed at a stored position opposing the detection member to interpose the separation unit therewith in a mounted state in which the separation unit is mounted to the mounting part, and is disposed at a restricting position that restricts the detection member from moving from the initial position to the retracted position by abutting the detection member, in a detached state in which the separation unit is detached from the mounting part.

In addition, the present invention relates to a image forming apparatus, comprising: an image forming portion; a housing in which the image forming portion is disposed to be housed; a placement portion on which at least one image formation target material can be placed; a feed roller that is disposed to oppose an upper surface of at least one image formation target material placed on the placement portion to be disposed at a predetermined feed position, and feeds a topmost image formation target among the at least one image formation target material to inside of the housing; a supply feed path in which image formation target materials are fed; a separation unit that is disposed at a predetermined mounting part so as to configure a portion of the supply feed path and is detachable relative to the mounting part, and includes a separation member that is disposed to oppose the feed roller on a more downstream side in a feed direction in which the image formation target materials are fed than the feed position, and is disposed so as to insert, between and the feed roller, the image formation target material; a position detection part that can detect that at least one image formation target material is disposed at a predetermined position on the placement portion, and includes: a detection member that can move between an initial position that is a position at which a leading end of the at least one image formation target material is abutted in a case of the at least one image formation target material being moved from the predetermined position to the feed position or a feed setup position that is in the vicinity of the feed position and is for moving image formation target material to the feed position by a predetermined lift member, and a retracted position retracted from the placement portion in a state in which the at least one image formation target material is disposed at the feed position or the feed setup position, and a detecting part which can detect that the detection member is at the retracted position; and a restricting member that is disposed at a stored position opposing the detection member to interpose the separation unit therewith, in a mounted state in which the separation unit is mounted to the mounting part, and is disposed at a restricting position that restricts the detection member from moving from the initial position to the retracted position by abutting the detection member, in a detached state in which the separation unit is detached from the mounting part.

DETAILED DESCRIPTION OF THE INVENTION

Figure 1:
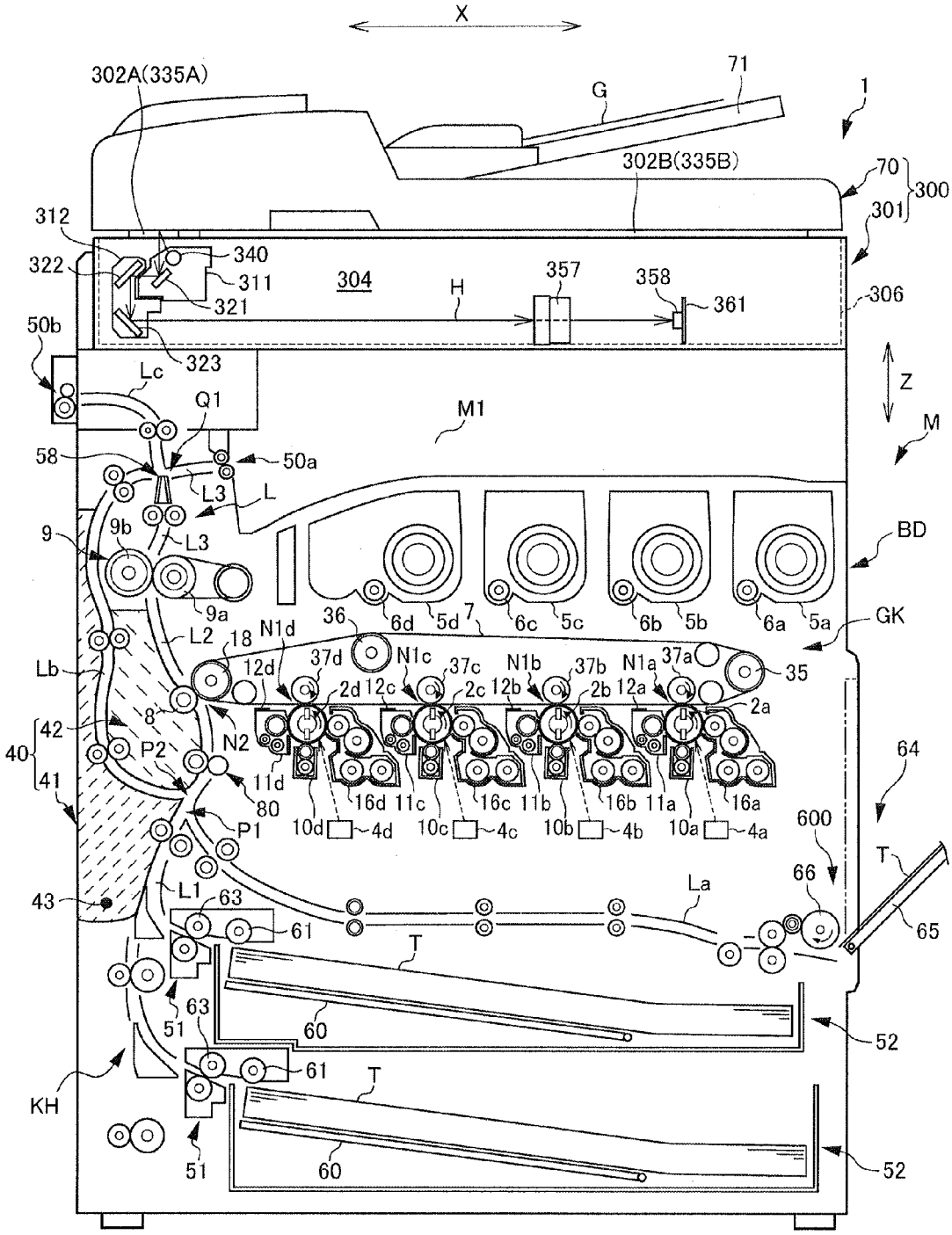
FIG. 1 is a view illustrating the arrangement of each constitutional element of a copy machine 1 of the present invention.

Hereinafter, preferred modes for carrying out the present invention will be explained while referring to the drawings.

The overall configuration of a copy machine 1 as an image forming apparatus of the present embodiment will be explained according to FIG. 1. FIG. 1 is a view illustrating an arrangement of each constitutional element of the copy machine 1.

As shown in FIG. 1, the copy machine 1 as an image forming apparatus includes an image reading device 300 that is disposed at an upper side of the copy machine 1 in the vertical direction Z, and an apparatus main body M that is disposed at a lower side of the copy machine 1 in the vertical direction Z and forms a toner image on paper T, which serves as an image formation target material of sheet-shape, based on image information read from the image reading device 300.

It should be noted that, in the explanation of the copy machine 1, the sub scanning direction X is also referred to as the "horizontal direction" of the copy machine 1, and the main scanning direction Y (direction penetrating into FIG. 1) is also referred to as the "front-back direction" of the copy machine 1. The vertical direction Z of the copy machine 1 is orthogonal to the sub scanning direction X and the main scanning direction Y.

First, the image reading device 300 will be explained.

As shown in FIG. 1, the image reading device 300 includes a cover member 70, and a reading portion 301 that reads an image of an original G.

The cover member 70 is connected to be openable and closeable to the reading portion 301 by a connecting portion that is not illustrated. The cover member 70 has a function of protecting a reading surface 302A, which is described later.

The reading portion 301 includes a housing 306, and the reading surface 302A that is disposed at an upper side of the housing 306. Furthermore, in an internal space 304 of the housing 306, the reading portion 301 includes: a lighting portion 340 that has a light source; a plurality of mirrors 321, 322 and 323; a first frame body 311 and a second frame body 312 that move in the sub scanning direction X; an imaging lens 357; a CCD 358 serving as a reading device; and a CCD substrate 361 that performs predetermined processing on image information read by the CCD 358 and causes the image information to be output to an apparatus main body M side. The lighting portion 340 and the first mirror 321 are housed in the first frame body 311. The second mirror 322 and the third mirror 323 are housed in the second frame body 312.

The reading surface 302A extends in directions orthogonal to the sub scanning direction X and the main scanning direction Y, and covers a large part of the reading portion 301 in the sub scanning direction X. The original G is placed on the reading surface 302A. The first frame body 311 and the second frame body 312 each move in the sub scanning direction X while maintaining the length of a light path H described later (light path length) to be constant. The image of the original G placed on the reading surface 302A is thereby read.

In the internal space 304 of the housing 306, the plurality of mirrors 321, 322 and 323 form the light path H for causing the light from the original G to enter the imaging lens 357. In addition, since the first frame body 311 moves in the sub scanning direction X at a constant speed A and the second frame body 312 moves in the sub scanning direction X at a constant speed A/2, the length of the light path H is kept constant even during an image reading operation. The details of the reading portion 301 will be described later.

The apparatus main body M will be explained next.

The apparatus main body M has an image forming portion GK that forms a predetermined toner image on the paper T based on predetermined image information, and a paper feeding/ejection portion KH that feeds the paper T to the image forming portion GK and ejects the paper T on which a toner image has been formed.

The external form of the apparatus main body M is configured by a case body BD serving as a housing portion.

As shown in FIG. 1, the image forming portion GK includes: photoreceptor drums 2*a*, 2*b*, 2*c* and 2*d* as image carriers (photoreceptors); charging portions 10*a*, 10*b*, 10*c* and 10*d*; laser scanner units 4*a*, 4*b*, 4*c* and 4*d* serving as exposure units; developing units 16*a*, 16*b*, 16*c* and 16*d*; toner cartridges 5*a*, 5*b*, 5*c* and 5*d*; toner supply parts 6*a*, 6*b*, 6*c* and 6*d*; drum cleaning parts 11*a*, 11*b*, 11*c* and 11*d*; static eliminators 12*a*, 12*b*, 12*c* and 12*d*; an intermediate transfer belt 7; primary transfer rollers 37*a*, 37*b*, 37*c* and 37*d*; a secondary transfer roller 8; a counter roller 18; and a fusing portion 9.

As shown in FIG. 1, the paper feeding/ejection portion KH includes paper feed cassettes 52, a manual paper feed part 64, a paper feed path L for the paper T, a resist roller pair 80, and first paper ejection part 50*a*, and a second paper ejection part 50*b*. It should be noted that, the paper feed path L is a collection of a first paper feed path L1, a second paper feed path L2, a third paper feed path L3, a manual paper feed path La, a reverse paper feed path Lb, and a post-processing paper feed path Lc, as described later.

Each component of the image forming portion GK and the paper feeding/ejection portion KH will be explained in detail hereinafter.

First, the image forming portion GK will be explained.

In the image forming portion GK, charging by the charging parts 10*a*, 10*b*, 10*c* and 10*d*; exposure by the laser scanner units 4*a*, 4*b*, 4*c* and 4*d*; developing by the developing units 16*a*, 16*b*, 16*c* and 16*d*; primary transfer by the intermediate transfer belt 7 and the primary transfer rollers 37*a*, 37*b*, 37*c* and 37*d*; static elimination by the static eliminators 12*a*, 12*b*, 12*c* and 12*d*; and cleaning by the drum cleaning parts 11*a*, 11*b*, 11*c* and 11*d* are performed in order from an upstream side to a downstream side along the surfaces of the photoreceptor drums 2*a*, 2*b*, 2*c* and 2*d*, respectively.

In addition, in the image forming portion GK, secondary transfer by the intermediate transfer belt 7, the secondary transfer roller 8 and the counter roller 18, as well as fusing by the fusing portion 9, are performed.

The photoreceptor drums 2*a*, 2*b*, 2*c* and 2*d* are each made of a cylindrically shaped member, and function as a photoreceptor or an image carrier. Each of the photoreceptor drums 2*a*, 2*b*, 2*c* and 2*d* is disposed to be rotatable in the directions of the arrows in FIG. 1 about an axis extending in a direction orthogonal to the direction of movement of the intermediate transfer belt 7. An electrostatic latent image can be formed on the surface of each of the photoreceptor drums 2*a*, 2*b*, 2*c* and 2*d*.

The charging parts 10*a*, 10*b*, 10*c* and 10*d* are disposed to oppose the surfaces of the photoreceptor drums 2*a*, 2*b*, 2*c* and 2*d*, respectively. The charging parts 10*a*, 10*b*, 10*c* and 10*d* uniformly negatively charge (negative polarity) or positively charge (positive polarity) the surfaces of the photoreceptor drums 2*a*, 2*b*, 2*c* and 2*d*, respectively.

The laser scanner units 4*a*, 4*b*, 4*c* and 4*d* function as exposure units and are disposed to be spaced apart from the surfaces of the respective photoreceptor drums 2*a*, 2*b*, 2*c* and 2*d*. The laser scanner units 4*a*, 4*b*, 4*c* and 4*d* are configured to each include a laser light source, a polygonal mirror, a polygonal mirror drive motor, and the like, which are not illustrated.

The laser scanner units 4*a*, 4*b*, 4*c* and 4*d* scan and expose the surface of the photoreceptor drums 2*a*, 2*b*, 2*c* and 2*d*, respectively, based on image information related to an image read by the reading portion 301. By being scanned and exposed by the laser scanner units 4*a*, 4*b*, 4*c* and 4*d*, the electric charge of an exposed part of the surface of each of the photoreceptor drums 2*a*, 2*b*, 2*c* and 2*d* is removed. In this way, an electrostatic latent image is formed on the surface of each of the photoreceptor drums 2*a*, 2*b*, 2*c* and 2*d*.

The developing units 16*a*, 16*b*, 16*c* and 16*d* are provided so as to correspond to the photoreceptor drums 2*a*, 2*b*, 2*c* and 2*b*, respectively, and are disposed to oppose the surfaces of the photoreceptor drums 2*a*, 2*b*, 2*c* and 2*d*, respectively. The developing units 16*a*, 16*b*, 16*c* and 16*d* each cause toner of each color to adhere to the electrostatic latent image formed on the surface of each of the photoreceptor drums 2*a*, 2*b*, 2*c* and 2*d*, to form a color toner image on the surface of each of the photoreceptor drums 2*a*, 2*b*, 2*c* and 2*d*. The developing units 16*a*, 16*b*, 16*c* and 16*d* correspond to the four colors of yellow, cyan, magenta, and black, respectively. The developing units 16*a*, 16*b*, 16*c* and 16*d* are each configured to include developing rollers that are disposed to oppose the surface of the photoreceptor drums 2*a*, 2*b*, 2*c* and 2*d*, stirring rollers for toner stirring, and the like.

The toner cartridges 5*a*, 5*b*, 5*c* and 5*d* are provided to correspond to the developing units 16*a*, 16*b*, 16*c* and 16*d*, respectively, and store toners of each color supplied to the respective developing units 16*a*, 16*b*, 16*c* and 16*d*. The toner cartridges 5*a*, 5*b*, 5*c* and 5*d* store yellow toner, cyan toner, magenta toner, and black toner, respectively.

The toner supply parts 6*a*, 6*b*, 6*c* and 6*d* are provided to correspond to the toner cartridges 5*a*, 5*b*, 5*c* and 5*d* and the developing units 16*a*, 16*b*, 16*c* and 16*d*, respectively, and supply toner of each color stored in the respective toner cartridges 5*a*, 5*b*, 5*c* and 5*d* to the respective developing units 16*a*, 16*b*, 16*c* and 16*d*. The toner supply parts 6*a*, 6*b*, 6*c* and 6*d* are connected with the developing units 16*a*, 16*b*, 16*c* and 16*d*, respectively, by toner supply paths that are not illustrated.

The toner images of each color formed on the photoreceptor drums 2*a*, 2*b*, 2*c* and 2*d* are primarily transferred in sequence to the intermediate transfer belt 7. The intermediate transfer belt 7 is stretched around a driven roller 35, the counter roller 18 operating as a drive roller, a tension roller 36, and the like. Since the tension roller 36 biases the intermediate transfer belt 7 from the inside to the outside, a predetermined tension is applied to the intermediate transfer belt 7.

The primary transfer rollers 37*a*, 37*b*, 37*c* and 37*d* are disposed across the intermediate transfer belt 7 from the photoreceptor drums 2*a*, 2*b*, 2*c* and 2*d* so as to oppose the photoreceptor drums 2*a*, 2*b*, 2*c* and 2*d*, respectively.

Predetermined portions of the intermediate transfer belt 7 are sandwiched by the primary transfer rollers 37*a*, 37*b*, 37*c* and 37*d* and the photoreceptor drums 2*a*, 2*b*, 2*c* and 2*d*, respectively. These sandwiched predetermined portions are pressed against the surfaces of the photoreceptor drums 2*a*, 2*b*, 2*c* and 2*d*, respectively. First transfer nips N1*a*, N1*b*, N1*c* and N1*d* are formed between the photoreceptor drums 2*a*, 2*b*, 2*c* and 2*d* and the primary transfer rollers 37*a*, 37*b*, 37*c* and 37*d*, respectively. The toner images of each color developed on each of the photoreceptor drums 2*a*, 2*b*, 2*c* and 2*d* are primarily transferred in sequence to the intermediate transfer belt 7 at the respective primary transfer nips N1*a*, N1*b*, N1*c* and N1*d*. A full color toner image is thereby formed on the intermediate transfer belt 7.

A primary transfer bias for causing the toner images of each color formed on the respective photoreceptor drums 2*a*, 2*b*, 2*c* and 2*d* to transfer to the intermediate belt 7 is applied to each of the primary transfer rollers 37*a*, 37*b*, 37*c* and 37*d* by a primary transfer bias applying part that is not illustrated.

The static eliminators 12*a*, 12*b*, 12*c* and 12*d* are disposed to oppose the surfaces of the photoreceptor drums 2*a*, 2*b*, 2*c* and 2*d*, respectively. The static eliminators 12*a*, 12*b*, 12*c* and 12*d* remove electricity (eliminate an electrical charge) from the surfaces of the photoreceptor drums 2*a*, 2*b*, 2*c* and 2*d*, respectively, after the primary transfer has been performed, by irradiating light onto the surface of each of the photoreceptor drums 2*a*, 2*b*, 2*c* and 2*d*.

The drum cleaning parts 11*a*, 11*b*, 11*c* and 11*d* are disposed to oppose the surfaces of the photoreceptor drums 2*a*, 2*b*, 2*c* and 2*d*, respectively. The drum cleaning parts 11*a*, 11*b*, 11*c* and 11*d* remove toner and attached matter remaining on the surfaces of the photoreceptor drums 2*a*, 2*b*, 2*c* and 2*d*, respectively, and make the removed toner, etc. carried to a predetermined collection mechanism for collection.

The secondary transfer roller 8 secondarily transfers the full color toner image, which was primarily transferred to the intermediate transfer belt 7, to the paper T. A secondary transfer bias for causing the full color toner image formed on the intermediate transfer belt 7 to transfer to the paper T is applied to the secondary transfer roller 8 by a secondary transfer bias applying part that is not illustrated.

The secondary transfer roller 8 can be either brought into contact with or spaced apart from the intermediate transfer belt 7. More specifically, the secondary transfer roller 8 is configured to be movable between a contact position that is in contact with the intermediate transfer belt 7 and a spaced position that is spaced apart from the intermediate transfer belt 7. In particular, the secondary transfer roller 8 is disposed at the contact position in a case of causing the full color toner image primarily transferred to the surface of the intermediate transfer belt 7 to be secondarily transferred to the paper T, and is disposed at the spaced position in other cases.

The counter roller 18 is disposed on an opposite side of the intermediate transfer belt 7 than the secondary transfer roller 8. Predetermined portions of the intermediate transfer belt 7 are sandwiched by the secondary transfer roller 8 and the counter roller 18. Then, the paper T is pressed against the outer surface (surface to which the toner image is primarily transferred) of the intermediate transfer belt 7. A secondary transfer nip N2 is formed between the intermediate transfer belt 7 and the secondary transfer roller 8. The full color toner image, which was primarily transferred to the intermediate transfer belt 7, is secondarily transferred to the paper T at the secondary transfer nip N2.

The fusing portion 9 heats and melts the toner of each color configuring the toner image secondarily transferred to the paper T in order to fuse to the paper T. The fusing portion 9 includes a heated rotating body 9*a* that is heated by a heater, and a pressure rotating body 9*b* that is brought into pressurized contact with the heated rotating body 9*a*. The heated rotating body 9*a* and the pressure rotating body 9*b* sandwich, compress, and also feed the paper T secondarily transferred. By the paper T being fed in a state sandwiched between the heated rotating body 9*a* and the pressure rotating body 9*b*, the toner transferred to the paper T is fused to the paper T by being melted and pressed.

Next, the paper feeding/ejection portion KH will be explained.

As shown in FIG. 1, two paper feed cassettes 52, which store the paper T, are disposed to be aligned vertically in a lower portion of the apparatus main body M. The paper feed cassettes 52 are configured to be able to be pulled out from the housing of the apparatus main body M in a horizontal direction. A paper tray 60 on which the paper T are placed is disposed in each of the paper feed cassettes 52. The paper T is stored in a state of being stacked on the paper tray 60 in the respective paper feed cassettes 52. The paper T placed on the paper tray 60 is fed to the paper feed path L by the cassette paper feed part 51 disposed at an end (end on left side in FIG. 1) of the paper feed cassette 52 on a paper feeding side. The cassette feed part 51 includes a double feed prevention mechanism consisting of a forward feed roller 61 for picking up paper T on the paper tray 60, and a feed roller pair 63 for feeding the paper T one at a time to the paper feed path L.

The manual paper feed part 64 is provided on a right lateral face (right side in FIG. 1) of the apparatus main body M. The manual paper feed part 64 is provided primarily for the purpose of supplying paper T of differing size and type from the paper T stored in the paper feed cassette 52 to the apparatus main body M. The manual paper feed part 64 includes a manual feed tray 65 constituting a portion of the right lateral face of the apparatus main body M in the closed state, and a paper feed roller 66 serving as a feed roller. The manual paper feed tray 65 functions as a paper tray on which one or a plurality of sheets of the paper T can be placed in the opened state, and has a lower end rotatably mounted (openable and closeable) in a vicinity of the paper feed roller 66. The paper feed roller 66 sends (feeds) the paper T placed on the manual paper feed tray 65 in the opened state towards the manual feed path La inside of the housing 306.

It should be noted that the feed mechanism 600 for the paper T containing the paper feed roller 66 of the manual paper feed tray 65 will be described later.

A first paper ejection part 50*a* and a second paper ejection part 50*b* are provided to an upper side of the apparatus main body M. The first paper ejection part 50*a* and the second paper ejection part 50*b* eject the paper T to outside the apparatus main body M. The details of the first paper ejection part 50*a* and the second paper ejection part 50*b* will be described later.

The feed path L feeding the paper T includes: a first paper feed path L1 from the cassette paper feed part 51 to the second transfer nip N2; a second paper feed path L2 from the second transfer nip N2 to the fusing portion 9; a third paper feed path L3 from the fusing portion 9 to the first paper ejection part 50*a*; the manual paper feed path La that guides paper supplied from the manual paper feed part 64 to the first paper feed path L1; a reverse paper feed path Lb that reverses and returns paper fed from the upstream side to the downstream side in the third paper feed path L3 to the first paper feed path L1; and a post-processing paper feed path Lc that feeds paper fed from the upstream side to the downstream side in the third paper feed path L3 to a post-processing device (not illustrated) connected to the second paper ejection part 50*b*.

In addition, a first junction P1 and a second junction P2 are provided in the middle of the first paper feed path L1. A first branch part Q1 is provided in the middle of the third paper feed path L3.

The first junction P1 is a junction at which the manual paper feed path La converges with the first paper feed path L1. The second junction P2 is a junction at which the reverse paper feed path Lb converges with the first paper feed path L1.

The first branch part Q1 is a branching part at which the post-processing paper feed path Lc branches from the third paper feed path L3. A dividing member 58 is provided at the first branch part Q1. The dividing member 58 causes the feed direction of the paper T fed from the fusing portion 9 to branch (switch between) the third paper feed path L3 toward the first paper ejection part 50*a* or the post-processing paper feed path Lc toward the second paper ejection part 50*b*.

A sensor for detecting paper T, and a resist roller pair 80 for skew compensation of the paper T and timing adjustment with respect to the formation of the toner image in the image formation portion GK are disposed in the middle of the first paper feed path L1 (specifically, between the second junction P2 and the second transfer roller 8)

The sensor is disposed directly before the resist roller pair 80 in the feed direction of the paper T (upstream side of the feed direction). The resist roller pair 80 feeds the paper T while performing the aforementioned compensation and timing adjustment based on detection signal information from the sensor.

The reverse paper feed path Lb is a feed path provided for making a surface (unprinted surface) opposite to a surface that has already been printed to face toward the intermediate transfer belt 7, when performing duplex printing on the paper T. According to the reverse paper feed path Lb, paper T fed from the first branch part Q1 to the first paper ejection part 50*a* side can be reversed and returned to the first paper feed path L1, so as to be fed to the upstream side of the resist roller pair 80 disposed on the upstream side of the second transfer roller 8. At the secondary transfer nip N2, a predetermined toner image is transferred to the unprinted surface of the paper T that has been reversed by the reverse paper feed path Lb.

The first paper ejection part 50*a* is formed at an end of the third paper feed path L3. The first paper ejection part 50*a* is disposed on the upper side of the apparatus main body M. The first paper ejection part 50*a* opens toward the right lateral face side of the apparatus main body M (right side in FIG. 1, manual paper feed part 64 side). The first paper ejection part 50*a* ejects the paper T fed through the third paper feed path L3 to outside of the apparatus main body M.

An ejected paper collection part M1 is formed on the opening side of the first paper ejection part 50*a*. The ejected paper collection part M1 is formed on an upper face (outer face) of the apparatus main body M. The ejected paper collection part M1 is a portion of the upper face of the apparatus main body M that is formed to be depressed downward. A bottom face of the ejected paper collection part M1 constitutes a portion of the upper face of the apparatus main body M. Sheets of the paper T on which a predetermined toner image has been formed and is ejected from the first paper ejection part 50*a* are collected by stacking on the ejected paper collection part M1.

The second paper ejection part 50*b* is formed at an end of the post-processing paper feed path Lc. The second paper ejection part 50*b* is disposed on an upper side of the apparatus main body M. The second paper ejection part 50*b* opens toward a left lateral face side of the apparatus main body M (left side in FIG. 1, side at which the post-processing device is connected). The second paper ejection part 50*b* ejects paper T fed through the post-processing feed path Lc to outside the apparatus main body M.

A post-processing device (not illustrated) is connected at an opening side of the second paper ejection part 50*b*. The post-processing device performs post-processing (stapling, punching, etc.) on paper discharged from the image forming apparatus (copy machine 1).

It should be noted that a sensor for paper detection is disposed at a predetermined position in each paper feed path.

Next, the structure for eliminating a paper jam (JAM) in the main paper feed paths L1 to L3 (hereinafter the first paper feed path L1, second paper feed path L2 and third paper feed path L3 are also collectively referred to as "main paper feed paths") and the reverse paper feed path Lb will be briefly explained.

As shown in FIG. 1, the main paper feed paths L1 to L3 and the reverse paper feed path Lb are aligned so as to extend primarily in the vertical direction on the left lateral face side of the apparatus main body M (left side in FIG. 1). A cover body 40 is provided to the left lateral face side of the apparatus main body M (left side in FIG. 1) so as to form a portion of the lateral face of the apparatus main body M. The cover body 40 is connected at a lower end thereof to the apparatus main body M via a pivot shaft 43. The axial direction of the pivot shaft 43 is arranged at a predetermined position along a direction intersecting the main paper feed paths L1 to L3 and the reverse paper feed path Lb. The cover body 40 is configured to be pivotable between a closed position (position shown in FIG. 1) and an opened position (not illustrated) about the pivot shaft 43.

The cover body 40 is configured from a first cover part 41 pivotably connected to the apparatus main body M by the pivot shaft 43, and a second cover part 42 pivotably connected to the apparatus main body M by the same pivot shaft 43. The first cover part 41 is located more towards the outside (lateral face side) of the apparatus main body M than the second cover part 42. It should be noted that, in FIG. 1, the portion hatched by dashed lines sloped down to the left is the first cover part 41, and the portion hatched by dashed lines sloped down to the right is the second cover part 42.

In the state in which the cover body 40 is located in the closed position, an outer face side of the first cover part 41 forms a portion of the outer face (lateral face) of the apparatus main body M.

In addition, in the state in which the cover body 40 is located in the closed position, the inner face side (apparatus main body M side) of the second cover part 42 forms a portion of the main paper feed paths L1 to L3.

Furthermore, in the state in which the cover body 40 is located in the closed position, the inner face side of the first cover part 41 and the outer face side of the second cover part 42 form at least a portion of the reverse paper feed path Lb. In other words, the reverse paper feed path Lb is formed between the first cover part 41 and the second cover part 42.

By providing the cover body 40 of such a configuration, the copy machine 1 of the present embodiment allows for a sheet of paper blocking the main paper feed paths L1 to L3 to be handled by pivoting the cover body 40 from the closed position illustrated in FIG. 1 to the opened position (not illustrated) to open the main paper feed paths L1 to L3, when a paper jam (JAM) occurs in the main paper feed paths L1 to L3. On the other hand, when a paper jam occurs in the reverse paper feed path Lb, a sheet of paper blocking the reverse paper feed path Lb can be handled by causing the second cover part 42 to pivot about the pivot shaft 43 to the apparatus main body M side (right side in FIG. 1) to open the reverse paper feed path Lb, after having pivoted the cover body 40 to the opened position.

Next, the configuration relating to the feed mechanism (device) 600 of paper T in the copy machine 1 of the present embodiment will be explained while referring to FIGS. 2 to 6.

Figure 2:
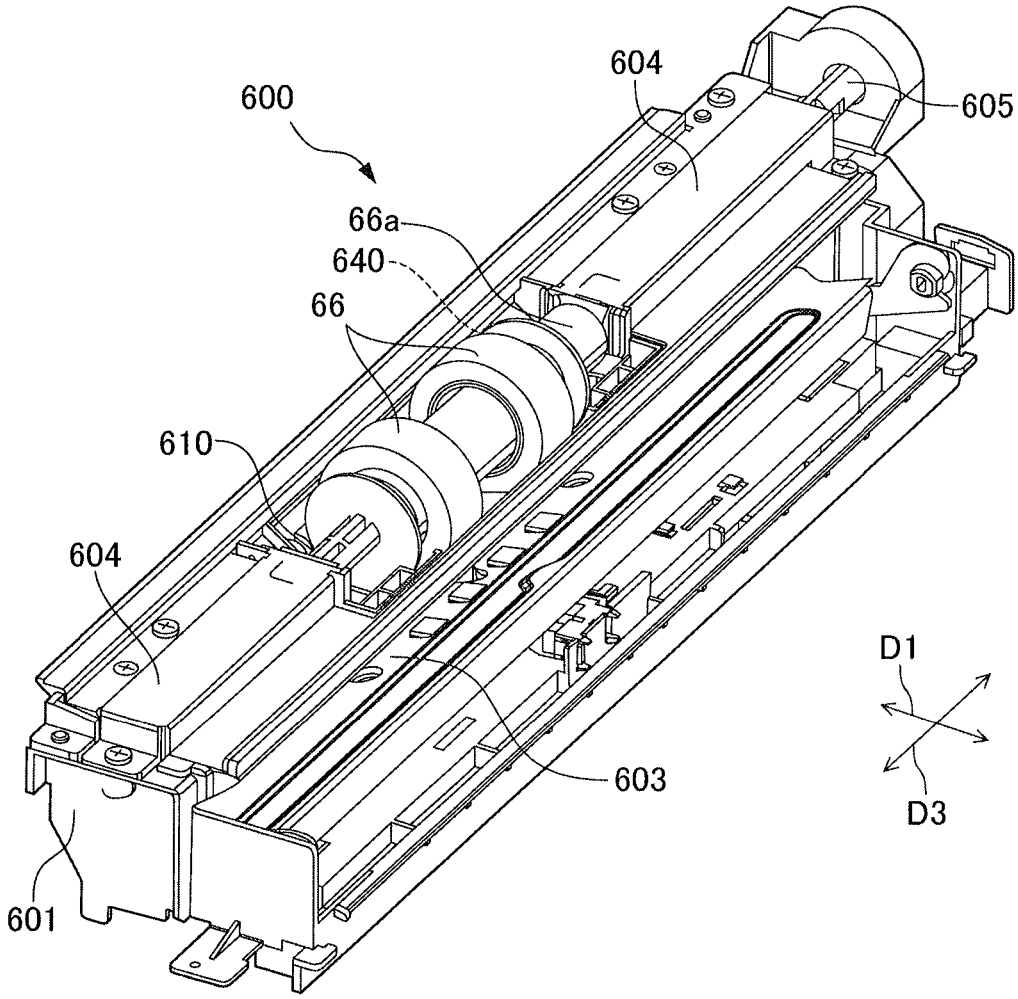
FIG. 2 is a perspective view when the entirety of a feed mechanism 600 of the copy machine 1 shown in FIG. 1 is viewed from above at an angle from the right lateral face side of a device main body M.
Figure 3:
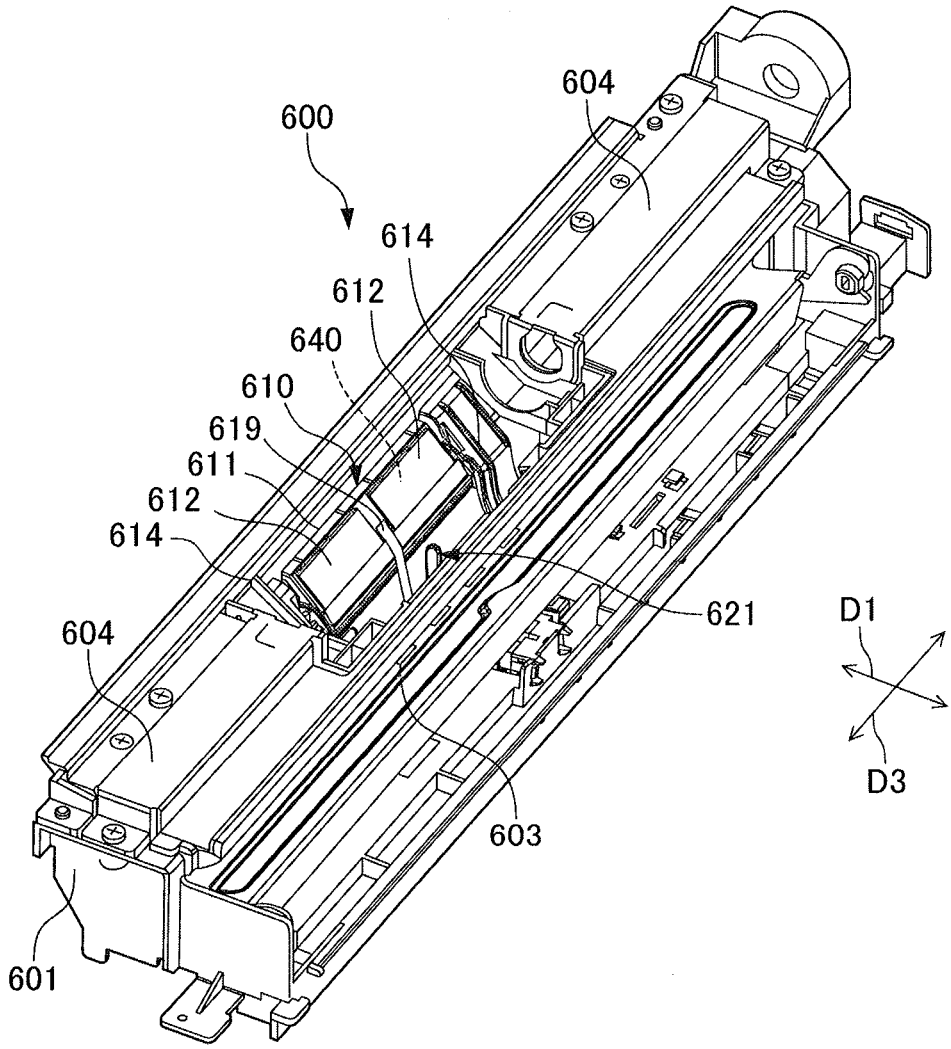
FIG. 3 is a perspective view when a state in which a paper feed roller 66 of the feed mechanism 600 is removed in the copy machine 1 shown in FIG. 1 is viewed from above at an angle from the right lateral face side of the device main body M.
Figure 4:
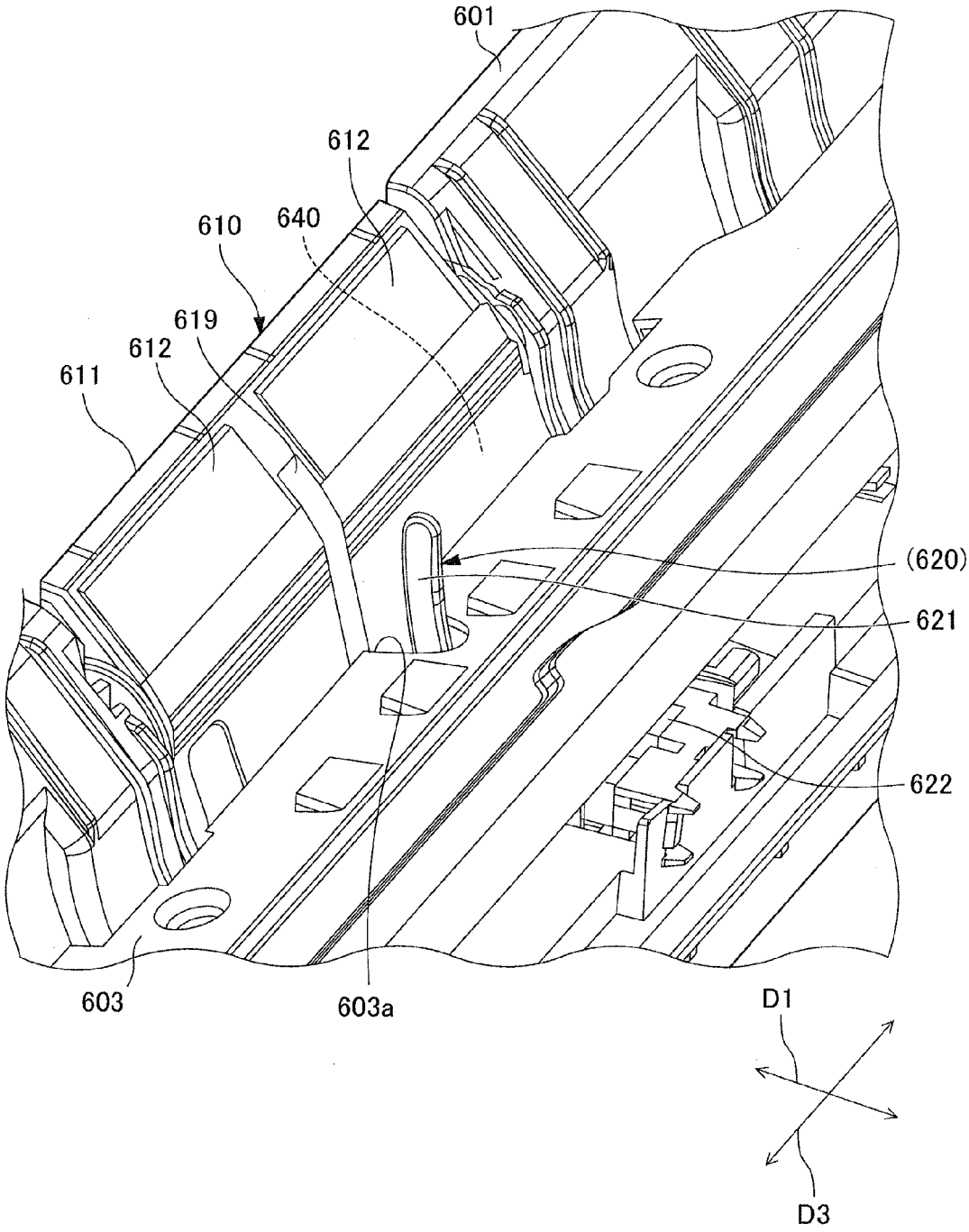
FIG. 4 is a perspective view in which a region in the vicinity of a detection member 621 in FIG. 3 is enlarged.
Figure 5:
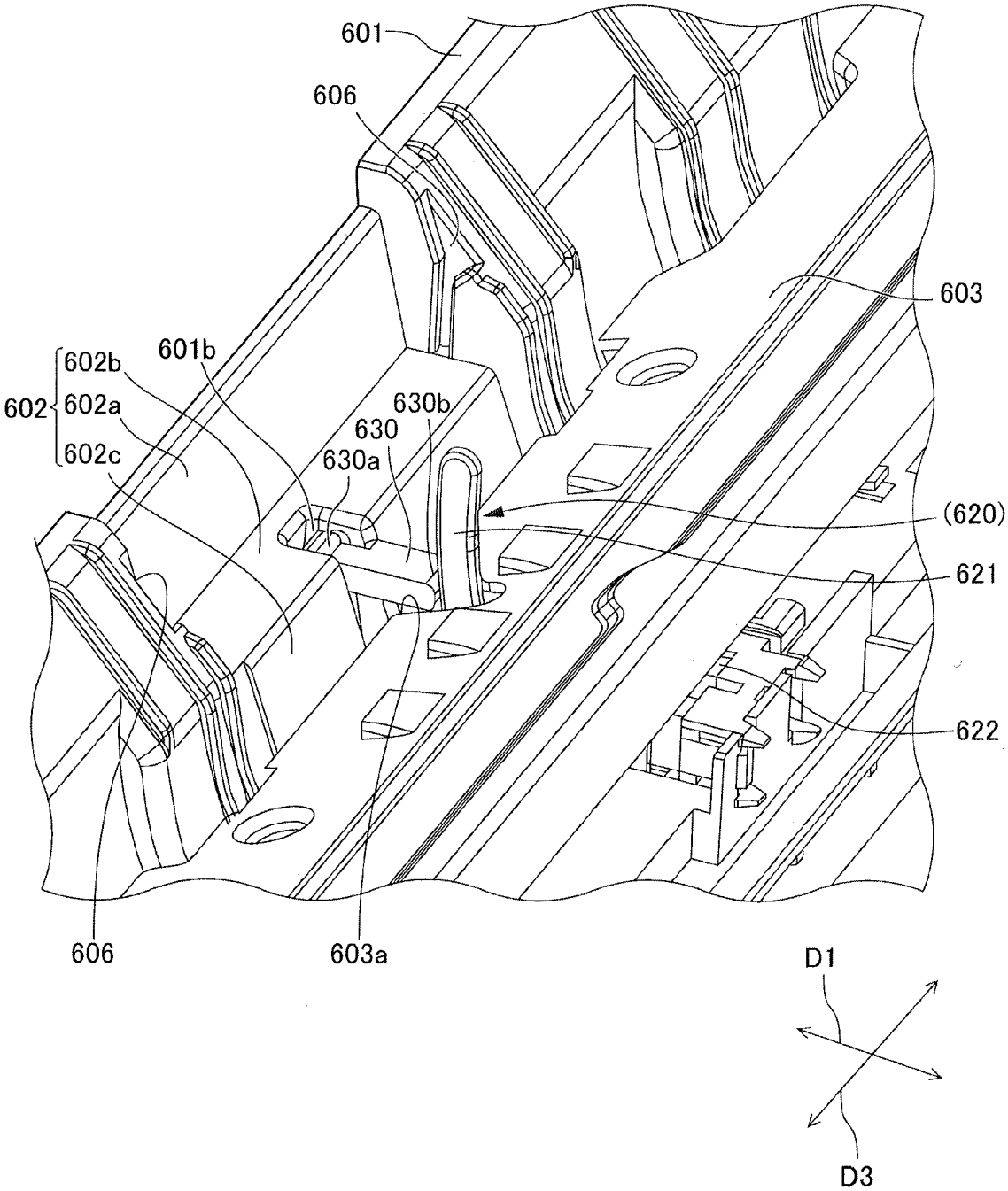
FIG. 5 is a perspective view in which a region in the vicinity of the detection member 621 is enlarged in a state where a pad unit 610 in FIG. 4 is detached.
Figure 6:
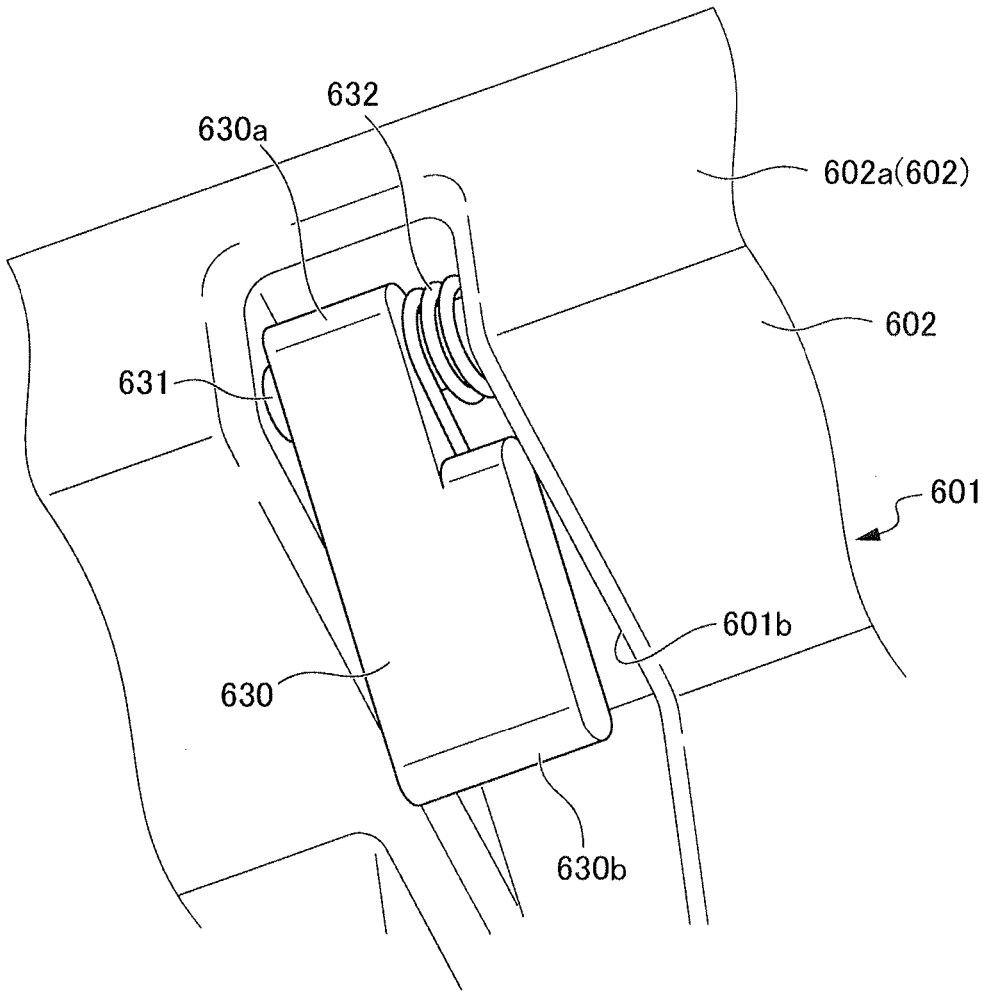
FIG. 6 is an enlarged perspective view illustrating an installed state of a restricting member 630.

FIG. 2 is a perspective view when the entirety of the feed mechanism 600 is viewed from above at an angle from the right lateral face side of the device main body M. FIG. 3 is a perspective view when the feed mechanism 600 is viewed from above at an angle from the right lateral face side of the device main body M in a state in which the paper feed roller 66 is removed. FIG. 4 is a perspective view in which a region in the vicinity of a detection member 621 in FIG. 3 is enlarged. FIG. 5 is a perspective view in which a region in the vicinity of the detection member 621 is enlarged in a state where the pad unit 610 is detached in FIG. 4. FIG. 6 is an enlarged perspective view illustrating an installed state of a restricting member 630.

The feed mechanism 600 connects with a lower end of the manual paper feed tray 65 of the manual paper feed part 64 and is disposed inside of the apparatus main body M (refer to FIG. 1).

As shown in FIGS. 2 to 5, the feed mechanism 600 includes a casing 601, the paper feed roller (feed roller) 66, a paper feed drive shaft 605, the pad unit 610, the lift plate (ascending/descending member) 603, a paper supply feed path 640, a position detection part 620 for paper T, and the restricting member 630.

The casing 601 is disposed on a feed beginning side of the manual paper feed path La in the paper feed path L, which is a downstream side in the feed direction D1 (refer to FIGS. 2 and 3) of paper T. The casing 601 is fixed to the apparatus main body M.

As shown in FIG. 5, a mounting part 602 to which the pad unit 610 is mounted is formed in the casing 601. The mounting part 602 is located substantially in the center of the casing 601 in the orthogonal direction D3, and is configured to include a first wall 602*a* abutted (opposed) by the back face of the pad unit 610, and a horizontal step part 602*b* and second wall part 602*c*. The pad unit 610 is detachably mounted to the mounting part 602.

As shown in FIG. 5, a recess 601*b* in which the restricting member 630 described later is disposed to be housed is formed in the casing 601. The recess 601*b* is a narrow concaved part formed by cutting out the horizontal step part 602*b* and the second wall part 602*c* of the mounting part 602.

In addition, a support tube 604 that rotatably supports the paper feed drive shaft 605 is formed in the casing 601.

The paper feed roller 66 is disposed on a downstream side of the casing 601 in the feed direction D1. The paper feed roller 66 is disposed so as to be positioned substantially in the center of the casing 601 in the orthogonal direction D3. The paper feed roller 66 is disposed to be spaced above the placement surface of the manual paper feed tray 65 and the lift plate 603.

The paper feed roller 66 is disposed to oppose a separation pad member (handle member) 612 of the pad unit 610 described later. The paper feed roller 66 is disposed at an upper side in the vertical direction (above) of the pad unit 610.

Figure 8A:
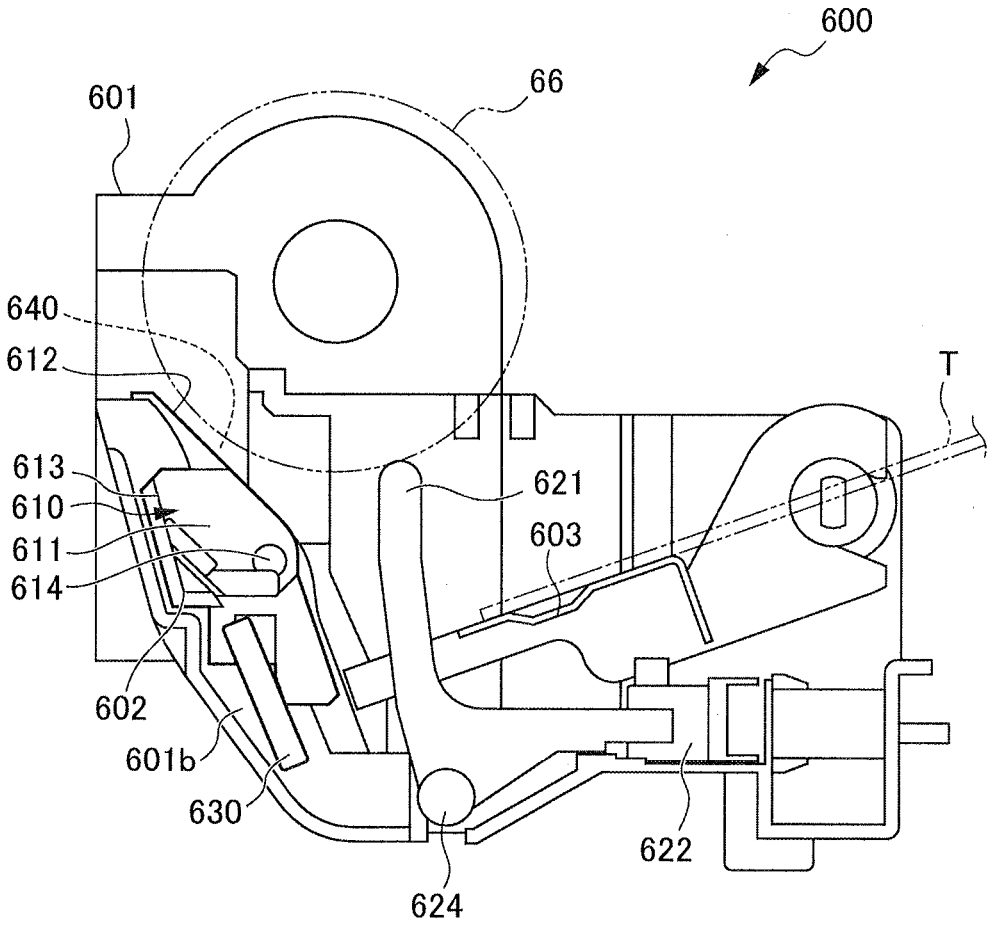
FIG. 8A is a view illustrating a state in which the pad unit 610 is mounted to a mounting part 602 of a casing 601.
Figure 8B:
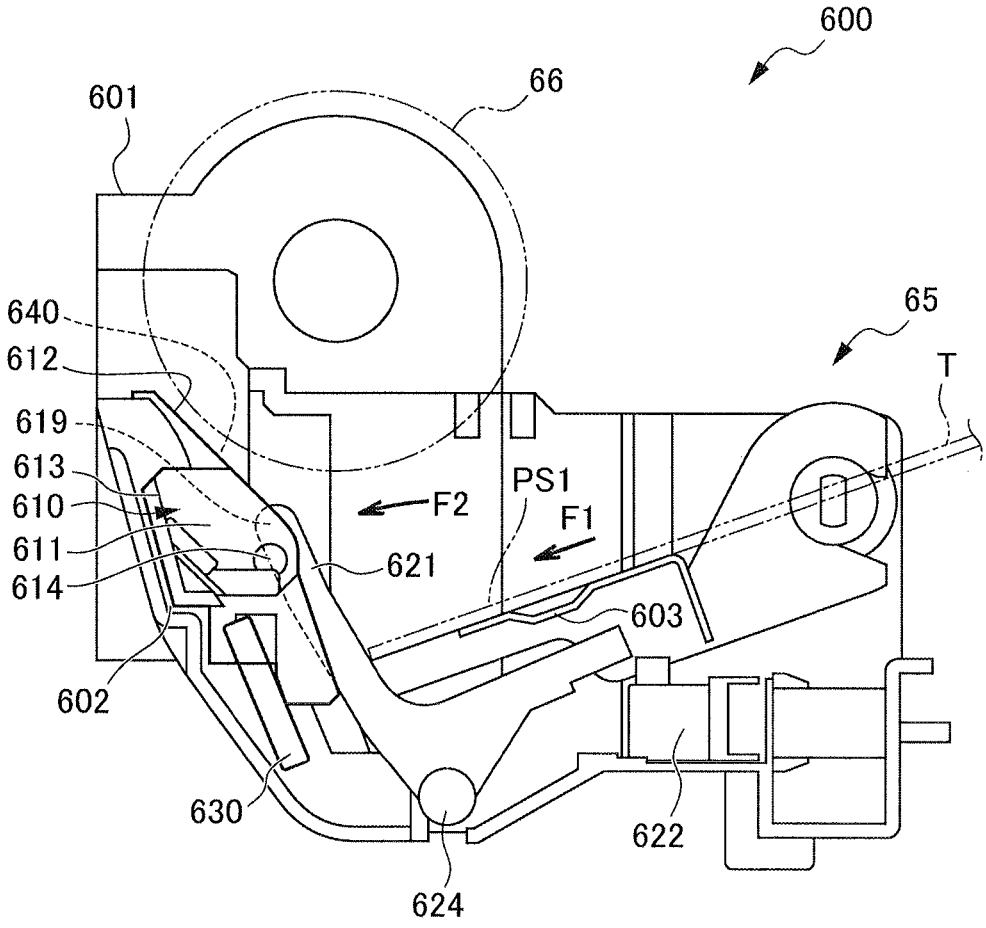
FIG. 8B is a view illustrating a state in which paper T is moved from the state in FIG. 8A in the arrow F1 direction and the detection member 621 pivotally moves.
Figure 8C:
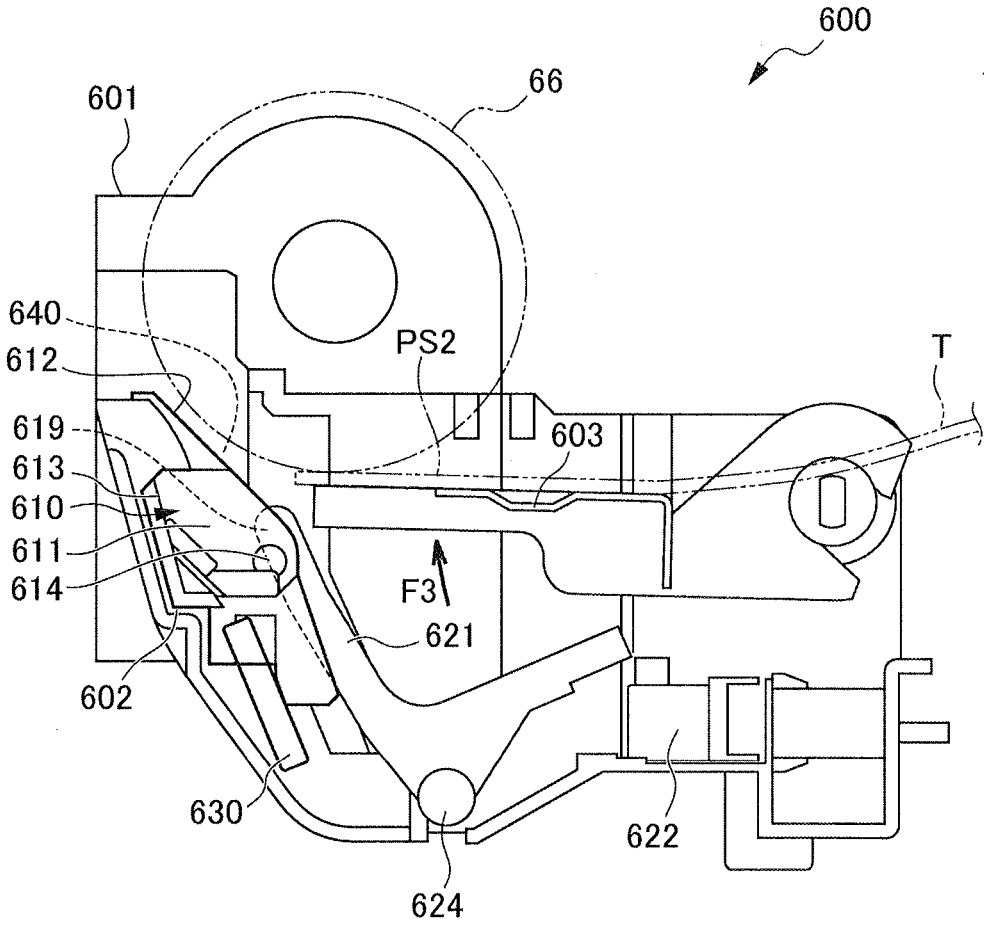
FIG. 8C is a view illustrating a state in which a lift plate 603 rises from the state in FIG. 8B.

The paper feed roller 66 is disposed to oppose (abut) the top face of one or a plurality of sheets of paper T disposed at the feed position (refer to FIG. 8C, position PS2). The paper feed roller 66 is a paper feed roller (feed roller) that feeds the sheet of paper T on the topmost side among one or a plurality of sheets of paper T disposed at the feed position towards the manual paper feed path La inside the apparatus main body M.

The paper feed roller 66 is disposed at the upper side of the casing 601 in the vertical direction to be detachable.

The paper feed roller 66 is of substantially columnar form, and is detachably mounted to the paper feed drive shaft 605 that is rotatably retained (supported) to the support tube 604 at both ends in the orthogonal direction D3.

Herein, the paper feed drive shaft 605 is connected to a drive portion 700 at an end on a side opposite to the paper feed roller 66 either directly or indirectly via a gear member or the like. The paper feed roller 66 is rotationally driven by the rotational drive force output from the drive portion 700. The rotationally driven paper feed roller 66 feeds (paper feeds) a sheet of paper T disposed to be opposing the paper feed roller 66 inside the apparatus main body M along the paper supply feed path 640 described later.

As shown in FIGS. 2 and 3, the pad unit 610 is configured to be detachable relative to the mounting part 602 of the casing 601.

In a state mounted to the mounting part 602, the pad unit 610 is disposed so as to configure a portion of the paper supply feed path 640 described later. In addition, in a state mounted to the mounting part 602, the pad unit 610 is disposed on a downstream side of the paper T in the feed direction D1, below (lower side in the vertical direction) the paper feed roller 66.

The pad unit 610 includes a pad holder 611, a separation pad member 612 pasted to the pad holder 611, and a mount holder 613 (refer to FIG. 8A) abutted to (placed on) the mounting part 602 of the casing 601. In addition, a notch portion 619 in which the detection member 621 described later is housed in a state positioned in a retracted position is formed in the pad unit 610.

The mount holder 613 retains the pad holder 611. The mount holder 613 has a pair of rib parts (not illustrated) formed in both end faces thereof in the orthogonal direction D3. The rib parts are formed to be able to insert (engage) into a pair of grooved parts 606 formed at both end sides of the mounting part 602 of the casing 601 in the orthogonal direction D3. The pad unit 610 is detachable relative to the mounting part 602 by sliding in the direction in which the groove parts 606 extend, in a state in which the pair of rib parts of the mount holder 613 is inserted (engaged) in the pair of groove parts 606 on the casing 601 side.

The pad holder 611 is mounted to the mount holder 613. The pad holder 611 has a shaft 614 formed at both end faces in a longitudinal direction thereof (orthogonal direction D3). The pad holder 611 is mounted to the mount holder 613 to be rotatable about the shafts 614, by sticking the pair of shafts 614 into holes (not illustrated) formed in inner faces on both ends of the mount holder 613. The pad holder 611 is biased so as to pivot in a direction approaching the paper feed roller 66, by the elastic force (resilience) of a spring that is not illustrated disposed between the pad holder 611 and the mount holder 613.

In addition, separation pad members 612, 612 are pasted to the pad holder 611.

The separation pad members 612, 612 are pasted to the pad holder 611. The separation pad members 612, 612 are pasted to the pad holder 611, which is mounted to the mount holder 613. In the present embodiment, the two separation pad members 612, 612 are disposed to be aligned in the orthogonal direction D3 interposing a portion of the notch portion 619. The separation pad members 612 are disposed further downstream in the feed direction D1 than the feed position (position of paper T that can be fed in the feed direction D1 by the paper feed roller 66) to oppose the paper feed roller 66, in a state in which the pad unit 610 is installed to the casing 601.

The separation pad member 612 is disposed so as to insert, therebetween and the paper feed roller 66, the paper T.

The separation pad member 612 is biased so as to pivot in a direction to contact the paper feed roller 66 (or paper T), by the elastic force (resilience) of a spring via the pad holder 611.

The separation pad member 612 contacts or moves away from the paper feed roller 66 (or paper T) by the pad holder 611 pivoting relative to the casing 601 (apparatus main body M) about the shafts 614.

The notch portion 619 is a portion in which the detection member 621 positioned in the retracted position is housed.

The notch portion 619 is a concave portion that is formed to span the pad holder 611 and the mount holder 613. The notch portion 619 is formed at a position opposing the detection member 621. The notch portion 619 is formed in a size and shape that allows the detection member 621 positioned in the retracted position to be housed therein.

The lift plate 603 (ascending/descending member) is disposed at a lower side in the vertical direction (below) of the paper feed roller 66. The lift plate 603 is a flat member that causes a sheet of paper T placed on a paper feed setup position of the manual paper feed tray 65 to contact or separate from the paper feed roller 66. The lift plate 603 is a member that presses a sheet of paper T disposed at the paper feed setup position to the paper feed roller 66 or releases pressing by moving up or down relative (toward) the paper feed roller 66 by way of a lift drive portion that is not illustrated.

The paper supply feed path 640 is a paper feed path in which paper T placed on the placement surface of the manual paper feed tray 65 is fed to inside of the apparatus main body M.

The paper supply feed path 640 includes an upper space of the placement surface of the manual paper feed tray 65 further upstream in the feed direction D1 than the upper surface of the lift plate 603. The paper supply feed path 640 is a paper feed path in which paper T is fed from the upper space of the placement surface of the manual paper feed tray 65, past the upper surface of the lift plate 603 and the upper surface of the separation pad member 612, until an opening part of the manual paper feed path La inside of the apparatus main body M.

In the present embodiment, the paper supply feed path 640 refers to a paper feed path in which paper T fed by the paper feed roller 66 is fed in a state in which the lift plate 603 is raised (state in which topmost face of the paper T abuts the paper feed roller 66).

The position detection part 620 has a detection member 621, a switch part 622, and a detector 623 that is a functional part of a CPU 740 described later.

The position detection part 620 is a position detector that detects the presence of paper T on the manual paper feed tray 65.

More specifically, the position detection part 620 is a position detector that detects the fact that one or a plurality of sheets of the paper T has been placed at a predetermined position on the manual paper feed tray 65.

In detail, the position detection part 620 is a position detector that detects whether a sheet of paper T (leading end) placed on the manual paper feed tray 65 is disposed at a feed position that can be fed by the paper feed roller 66, or whether a sheet of paper T is disposed at a feed setup position (refer to FIG. 8B, position PS1) that is near the feed position and is for moving the paper T to the feed position by a predetermined ascending/descending member (the lift plate 603 in the present embodiment).

In addition, the position detection part 620 is a position detector that detects the detection member 621 being positioned at the retracted position. The position detection part 620 is a position detector that detects the detection member 621 being positioned at an initial position, or positioned at the retracted position.

The position detection part 620 detects a sheet of paper T being positioned at the feed position or feed setup position in a case of the detection member 621 being positioned at the retracted position. In other words, the position detection part 620 does not detect a sheet of paper T being positioned at the feed position or feed setup position in a case of not detecting the detection member 621 being positioned at the retracted position (detects that a sheet of paper T is not at the feed position or feed setup position).

The detection member 621 is disposed more on an upstream side of the pad unit 610 in the feed direction D1 than the separation pad member 612.

The detection member 621 is disposed to oppose the pad unit 610 in a state in which the pad unit 610 is installed.

The detection member 621 has a pair of rotating shafts 624, 624 formed so as to protrude outwards in the orthogonal direction D3 at the lower end side in the vertical direction. The detection member 621 is pivotably mounted to the casing 601 by the rotating shafts 624, 624.

The detection member 621 is configured to be movable between the initial position (refer to FIG. 8A) and the retracted position (refer to FIG. 8C).

The initial position is a position that is abutted to a leading end of a sheet of paper T when the paper T is moved from a predetermined placement position in a state placed on the manual paper feed tray 65 to the feed position or feed setup position on the lift plate 603 side.

In the present embodiment, the paper T is moved from the predetermined position to the feed setup position in a case of being placed on the manual paper feed tray 65, and then moved from the feed setup position to the feed position. In the present embodiment, the initial position is a position at which the leading end of the paper T is abutted in a case of paper placed on the manual paper feed tray 65 being moved from the predetermined position to the feed setup position.

In the present embodiment, the detection member 621 disposed at the initial position is arranged (at an attitude extending in the vertical direction) so as to project through the notch portion 603*a* formed at a leading end of the lift plate 603 and block a portion of the paper supply feed path 640 (refer to FIGS. 4, 5 and 8A).

In a state in which the paper T is disposed at the feed position or feed setup position, the retracted position is a position at which the detection member 621 does not abut the leading end of a topmost sheet of paper T fed by the paper feed roller 66. The retracted position is a position in which the detection member 621 does not restrict the feeding movement of the paper T fed by the paper feed roller 66. The retracted position is a position that does not block the paper supply feed path 640. The retracted position is a position retracted from the placement portion in a state in which the at least one paper T is disposed at the feed position or the feed setup position.

In the present embodiment, the detection member 621 positioned in the retracted position is housed in the aforementioned notch portion 619. The detection member 621 is pivotally moved from the initial position to the retracted position, which is the position housed in the notch portion 619. The detection member 621 is configured so as to be housed in the notch portion 619 and retract from the paper supply feed path 640 in a case of being moved from the initial position to the retracted position by the paper T.

The detection member 621 disposed in the retracted position is positioned to be retracted from the paper supply feed path 640, which is formed in a state in which the lift plate 603 is raised.

The switch part 622 outputs a predetermined signal to the CPU 740 (detector 623) described later, according to the position of the detection member 621. The switch part 622 outputs a predetermined signal to the CPU 740 (detector 623) when the detection member 621 is positioned at the retracted position, for example. The switch part 622 is disposed in the vicinity of the detect member 621, for example.

The detector 623 detects whether the detection member 621 is moving (positioned) to the retracted position. The detector 623 detects whether the detection member 621 is moving (positioned) to the retracted position by receiving a signal output from the switch part 622, for example.

The detector 623 detects (recognizes) that a plurality of sheets of paper T have been placed at the predetermined position of the manual paper feed tray 65, in a case of having detected that the detection member 621 is moving (positioned) to the retracted position. The detector 623 detects (recognizes) that the paper T is disposed at the feed position or feed setup position, in a case of having detected that the detection member 621 is moving (positioned) to the retracted position.

Then, the detector 623 outputs a predetermined signal to a drive controller 710 described later, in a case of having detected that detection member 621 moving (positioned) to the retracted position.

Herein, the drive controller 710 described later permits the drive portion 700 to enter a drivable state in a case of having received the predetermined signal from the detector 623. As a result, the paper feed roller 66 is not rotationally driven in a case of the detection member 621 not having been detected to be moving (positioned) to the retracted position by the detector 623.

As shown in FIGS. 5 and 6, the restricting member 630 is disposed to be storable in the concaved recess (stored position) 601*b* formed in the casing 601.

As shown in FIG. 8A, in a state in which the pad unit 610 is installed to the mounting part 602 of the casing 601, the restricting member 630 is disposed at a position opposing the detection member 621, interposing the pad unit 610.

As shown in FIG. 6, the restricting member 630 is pivotally supported around a support shaft 631 at a base end 630*a* thereof. The restricting member 630 is biased so as to pivotally move to a restricting position side described later, by the elastic force of a helicoidal spring (example of a biasing member) 632 wound around a portion of the support shaft 631.

The restricting member 630 is configured to be pivotally movable between a stored position (restriction release position, refer to FIG. 4), and a restricting position (refer to FIG. 5).

More specifically, the restricting member 630 is configured to be pivotally movable between a stored position (restriction release position, refer to FIG. 4) at which the pad unit 610 is positioned in an installed state installed to the mounting part 602, and a restricting position (refer to FIG. 5) at which the pad unit 610 is positioned in a detached state detached from the mounting part 602.

In particular, the restricting member 630 is configured to be pivotally movable between a stored position (restriction release position, refer to FIG. 4) separated from the detection member 621 and allowing pivotal movement of the detection member 621 from the initial position to the retracted position, in an installed state in which the pad unit 610 is installed to the mounting part 602, and a restricting position (refer to FIG. 5) project to stand at a substantially level attitude (attitude extending in the horizontal direction in FIG. 5), the leading end 603*b* abutting the detection member 621 (as a prop), and restricting pivotal movement of the detection member 621 from the initial position to the retracted position, in a detached state in which the pad unit 610 is detached from the mounting part 602.

It should be noted that the restricting member 630 may restrict such that the detection member 621 entirely cannot move from the initial position in a state abutting the detection member 621, or may restrict such that the detection member 621 moves slightly in the retracted position direction in a range that can catch the paper T.

Figure 7:
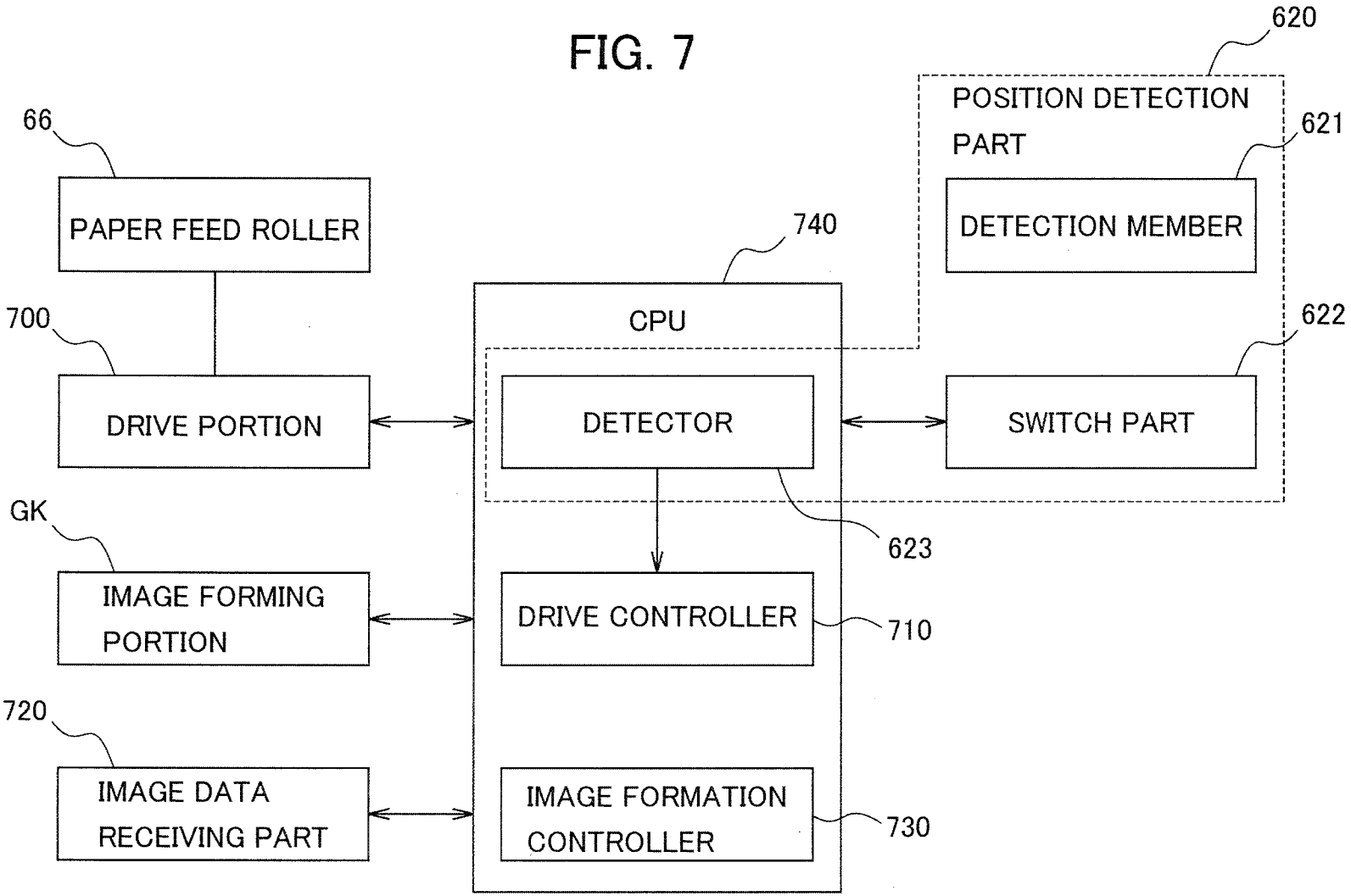
FIG. 7 is a block diagram illustrating a configuration of a control system of the copy machine 1.

Next, focusing on the feed mechanism 600, the configuration of the control system of the copy machine 1 will be explained while referring to FIG. 7. FIG. 7 is a block diagram illustrating the configuration of the control system of the copy machine 1.

As shown in FIG. 7, the copy machine 1 includes the paper feed roller 66, the drive portion 700 causing the paper feed roller 66 to rotationally drive, the detection member 621 and switch part 622 configuring the position detection part 620, the CPU 740, an image data receiving part 720, and the image forming portion GK.

The CPU 740 includes the detector 623 configuring the position detection part 620, the drive controller 710, and an image formation controller 730.

The drive portion 700 is a motor, and the like, that is connected to the paper feed roller 66 via the paper feed drive shaft 605, and rotationally drives the paper feed roller 66. The drive portion 700 is controlled by the drive controller 710.

The drive controller 710 controls the drive portion 700 so as to permit the drive portion 700 to rotationally drive in a state in which the detector 623 (position detection part 620) is detecting that the paper T is disposed at a predetermined feed position or the feed setup position, and so as not to permit the drive portion 700 to rotationally drive in a state in which the detector 623 (position detection part 620) has not detected that the paper T is disposed at the predetermined feed position or feed setup position.

In a state in which a predetermined signal indicating that the detection member 621 is positioned at the retracted position is received from the detector 623 (position detection part 620), the drive controller 710 permits the drive portion 700 to rotationally drive in a case of a signal requesting the driving of the drive portion 700 being received from the image formation controller 730 described later (outputs a drive signal to the drive portion 700).

In addition, in a state in which a predetermined signal indicating that the detection member 621 is positioned at the retracted position is not received from the detector 623 (position detection part 620) (or in a state in which a predetermined signal indicating that the detection member 623 is at the initial position), the drive controller 710 does not permit the drive portion 700 to rotationally drive in a case of a signal requesting driving of the drive portion 700 being received from the image formation controller 730 described later (does not output a drive signal to the drive portion 700).

The image data receiving part 720 receives image data read by the image reading device 300. Herein, image data includes an image formation instruction that is an instruction to the image formation portion GK to form predetermined toner images on the respective photoreceptor drums 2*a*, 2*b*, 2*c* and 2*d*, image information related to a toner image, paper number information, and the like.

The image formation controller 730 controls the image forming portion GK so as to cause toner images to be formed on the photoreceptor drums 2*a*, 2*b*, 2*c* and 2*d*, respectively. The image formation controller 730 outputs an image formation instruction to the image forming portion GK so as to cause toner images to be formed on the photoreceptor drums 2*a*, 2*b*, 2*c* and 2*d*, respectively, in a case of image data being received by the image data receiving part 720.

In addition, the image formation controller 730 outputs a signal requesting driving of the drive portion 700 to the drive controller 710, in a case of image data being received by the image data receiving part 720.

Next, operations of the copy machine 1 of the present embodiment will be briefly explained.

First, a sheet of paper T stored in the paper feed cassette 52 is fed to the first paper feed path L1 by the forward feed roller 61 and a feed roller pair 63, and subsequently, is fed to the resist roller pair 80 via the first junction P1 and the second paper feed path L2.

Skew correction of the paper T and timing adjustment with the toner image is performed at the resist roller pair 80.

The paper T sent from the resist roller pair 80 is introduced to the second transfer nip N2 between the intermediate transfer belt 7 and the second transfer roller 8 via the first paper feed path L1. Then, a toner image is transferred to the paper T between the intermediate transfer belt 7 and the second transfer roller 8.

Subsequently, the paper T is sent out from between the intermediate transfer belt 7 and the second transfer roller 8, and is introduced to between the heated rotating body 9*a* and the pressure rotating body 9*b* of the fusing portion 9, via the second paper feed path L2. Then, by the paper T being fed in a state sandwiched between the heated rotating body 9*a* and the pressure rotating body 9*b*, the toner transferred to the paper T is fused to the paper T by being heated and pressed thereby.

Next, the paper T is fed to the first paper ejection part 50*a* or second paper ejection part 50*b* via the third paper feed path L3, and is discharged to the ejected paper collection part M1 or outside of the apparatus main body M.

By performing operations in this way, printing of the paper T stored in the paper feed cassette 52 is completed.

In a case of printing on paper T placed on the manual paper feed tray 65, the paper T placed on the manual paper feed tray 65 is fed to the manual paper feed path La by the paper feed roller 66 (feed mechanism 600), and subsequently is fed to the resist roller pair 80 via the first junction P1 and the first paper feed path L1. The operations from then on are similar to the aforementioned operations of one-sided printing of a sheet of paper T stored in the paper feed cassette 52, and thus an explanation thereof will be omitted.

Herein, operations of the feed mechanism 600 that feeds paper T placed on the manual paper feed tray 65 into the apparatus main body M will be described in detail hereafter.

Next, operations of the feed mechanism 600 of paper T in the copy machine 1 of the present embodiment will be explained while referred to FIGS. 8A to 8E.

Figure 8D:
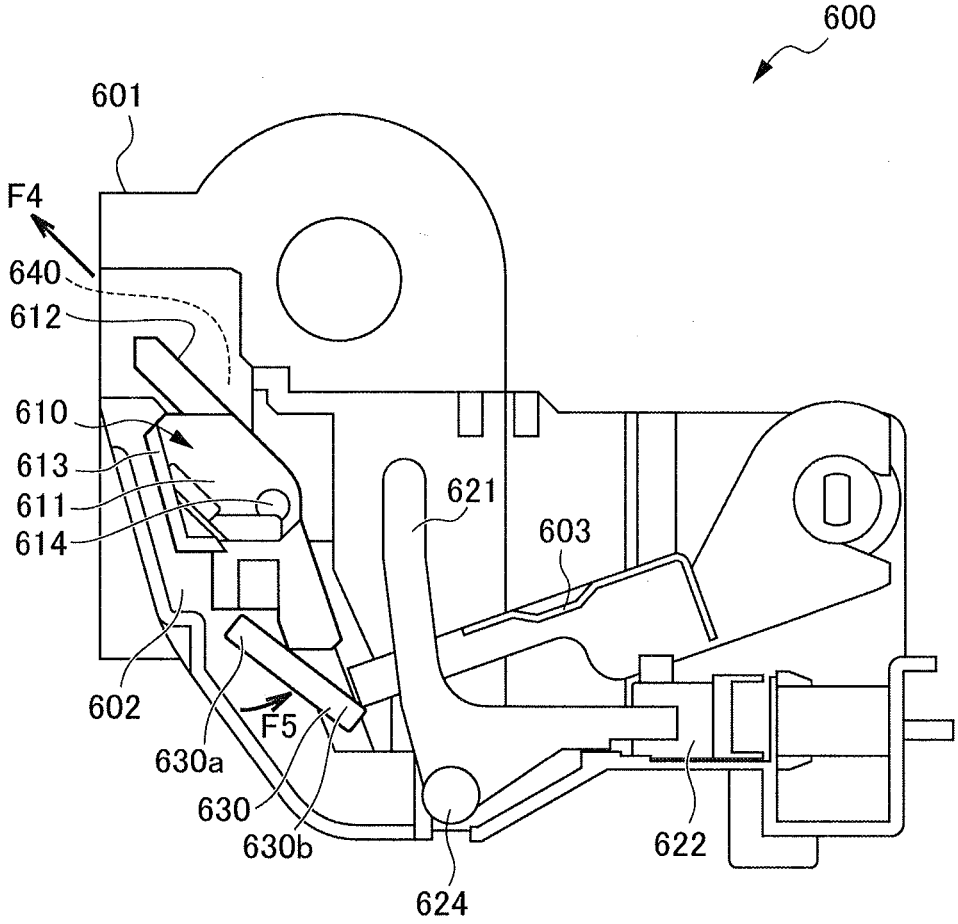
FIG. 8D is a view illustrating a state in which the pad unit 610 is made to move in the arrow F4 direction after the paper feed roller 66 has been removed.

FIG. 8A is a view illustrating a state in which the pad unit 610 is mounted to the mounting part 602 of the casing 601. FIG. 8B is a view illustrating a state in which the paper T is moved from the state in FIG. 8A in the arrow F1 direction and the detection member 621 pivotally moves. FIG. 8C is a view illustrating a state in which the lift plate 603 rises from the state in FIG. 8B. FIG. 8D is a view illustrating a state in which the pad unit 610 is made to move in the arrow F4 direction after the paper feed roller 66 has been removed. FIG. BE is a view illustrating a state in which the pad unit 610 is made to move further in the arrow F4 direction from the state in FIG. 8D to be detached from the mounting part 602.

First, in the state in which the pad unit 610 is mounted to the mounting part 602, as shown in FIG. 8A, the restricting member 630 is pressed to the pad unit 610 and is disposed to be housed inside of the recess 601*b*. In other words, the restricting member 630 separates from the detection member 621 of the position detection part 620 to be disposed in the restriction release position which permits pivotal movement of the detection member 621 from the initial position to the retracted position.

Next, when a sheet of paper T is made to move so as to insert in the arrow F1 direction accompanying the user placing a plurality of sheets of paper T on the placement surface of the manual paper feed tray 65 as shown in FIG. 8B, the detection member 621 disposed at the initial position is pivotally moved in the arrow F2 direction in a state abutted at a leading end of the paper T. Then, in a state in which the paper T is disposed at the feed setup position PS1, the detection member 621 is pivotally moved from the initial position to the retracted position.

Upon the detection member 621 being pivotally moved to the retracted position, the switch part 622 outputs a predetermined signal to the CPU 740 (detector 623). Then, upon receiving the predetermined signal from the switch part 622, the detector 623 outputs to the drive controller 710 a signal indicating that the detection member 621 is at the retracted position. The drive controller 710 having received this signal enters a state in which driving of the drive portion 700 is permissible.

In other words, in this state, the drive controller 710 outputs to the drive portion 700 a drive signal instructing to drive, in a case of having received from the image formation controller 730 a signal requesting to make the drive portion 700 driven.

In addition, the drive controller 710 similarly controls a lift drive portion (not illustrated) that drives the lift plate 603 to ascend or descend. In a state of receiving from the detector 623 a predetermined signal indicating that the detection member 621 is positioned at the retracted position, the drive controller 710 permits the lift drive portion to drive to ascend or descend in a case of having received from the image formation controller 730 described later a signal requesting the driving of the lift drive portion (outputs a lift drive signal to the lift drive portion).

By doing this, the lift plate 603 is ascendingly moved, as shown in FIG. 8C, and a leading end of a sheet of paper T not illustrated is disposed at the feed position PS2.

In addition, the paper T is thereby fed to the paper supply feed path 640 while double feeding is suppressed by being inserted between the paper feed roller 66 and the separation pad member 612 of the pad unit 610, and the paper T is fed to the manual paper feed path La inside of the apparatus main body M.

Then, in a case of the paper feed roller 66, the pad unit 610, etc. wearing and deteriorating, and it becoming necessary to replace with a new part or repair, the user can detach the pad unit 610 from the mounting part 602 of the casing 601 by removing the paper feed roller 66 to above the casing 601, and then causing the pad unit 610 to slide upwards through the space created by removing the paper feed roller 66.

First, when the pad unit 610 is made to move in the arrow F4 direction after having removed the paper feed roller 66 from the casing 1, as shown in FIG. 8D, the restricting member 630 is pivotally moved gradually upwards around the support shaft 631 by the biasing force of the helicoidal spring 632. The restricting member 630 is pivotally moved from the stored position to the restricting position side.

Figure 8E:
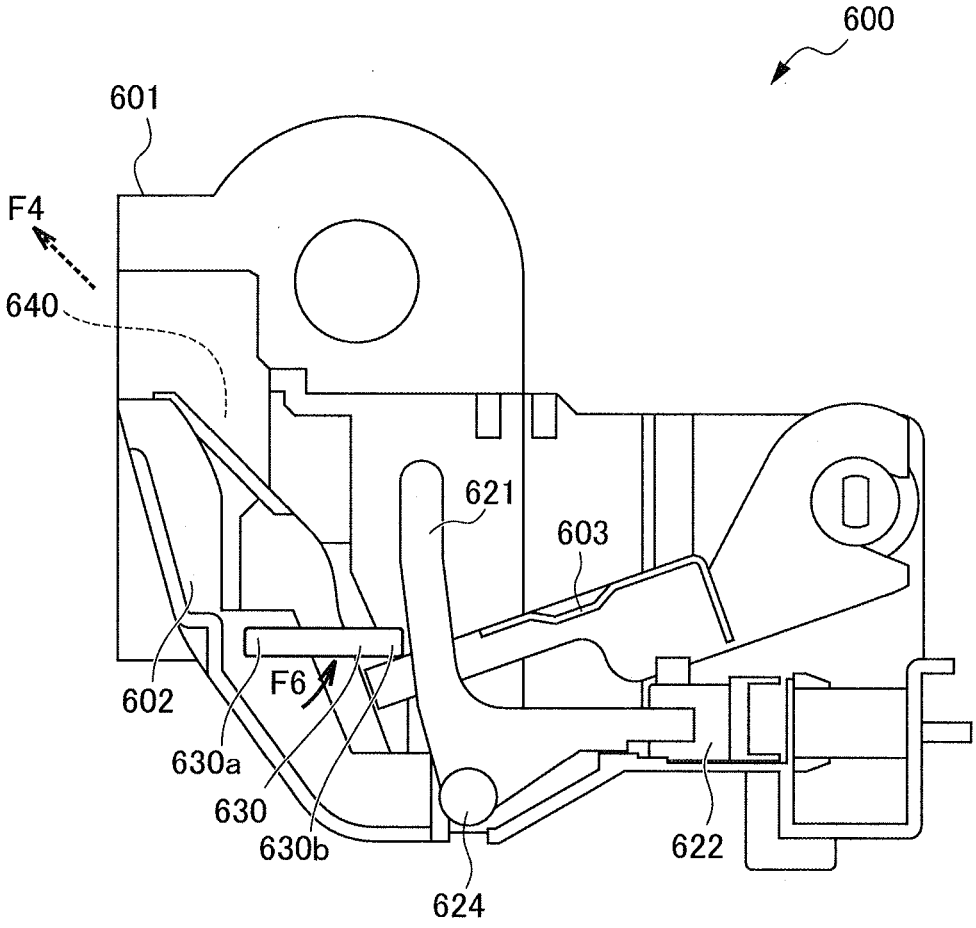
FIG. 8E is a view illustrating a state in which the pad unit 610 is made to move further in the arrow F4 direction from the state in FIG. 8D to be detached from the mounting part 602.

Then, in a state in which the pad unit 610 has been completely detached from the mounting part 602 of the casing 601 by moving in the arrow F4 direction, as shown in FIG. 8E, the restricting member 630 projects to stand at a substantially horizontal attitude, and is moved to the restricting position which is a position in which the leading end 630*b* thereof abuts the detection member 621 of the position detection part 620, and restricts the detection member 621 from pivotally moving from the initial position to the retracted position.

The detection member 621 of the position detection part 620 thereby comes to be maintained at a position such that a portion of the paper supply feed path 640 is blocked.

In other words, in the state shown in FIG. 8E, the detection member 621 restricts movement of paper T to the downstream side in the feed direction D1. The detection member 621, for which movement to the retracted position is restricted by the restricting member 630, restricts the paper T from being disposed (moved) to the feed position or feed setup position.

From a structural perspective, it is thereby possible to suppress paper T from becoming stacked and fed inside of the apparatus main body M (occurring by the pad unit 610 not being mounted), even in a case of the paper feed roller 66 being mounted in the state in which the pad unit 610 has been removed shown in FIG. 8E.

In addition, the detection member 621 is restricted from moving from the initial position to the retracted position, as explained above. In other words, in this state, the drive controller 710 is maintained in a state not permitting the drive portion 700 to drive.

From a control aspect, it is thereby possible to suppress the paper T from becoming stacked and fed inside of the apparatus main body M, even in a case of the paper feed roller 66 being mounted in a state in which the pad unit 610 has been removed shown in FIG. 8E.

Therefore, the feed mechanism 600 can suppress (prevent) malfunction such as a severe paper jam occurring due to the paper feed roller 66 being rotationally driven and the paper T being fed, even if the pad unit 610 is not mounted or one forgets to mount the pad unit 610 after replacement or repair.

Figure 9:
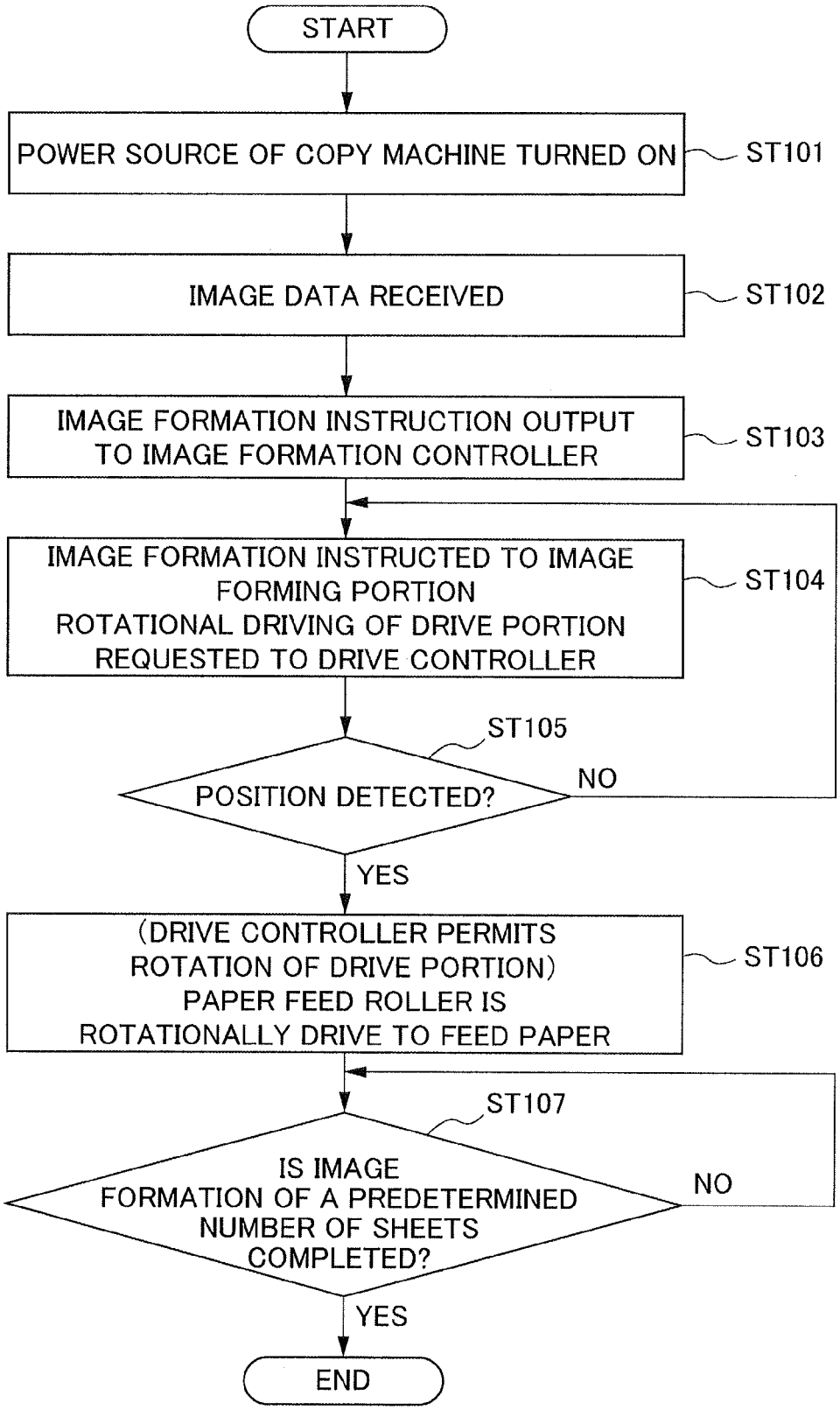
FIG. 9 is a flowchart illustrating operations of the control system of the copy machine 1.

Next, referring to FIG. 9, operations for suppressing the occurrence of malfunctions such as double feed and paper jams in a case of having forgotten to mount a new pad unit 610 to the mounting part 602 of the casing 601 after replacement or repair will be explained focusing on the operations of the control system of the copy machine 1 shown in FIG. 7. FIG. 9 is a flowchart illustrating operations of the control system of the copy machine 1.

First, a user removes the old pad unit from the mounting part 602, and then mounts the paper feed roller 66 to the casing 601 without installing the new pad unit.

Then, in Step ST101, the user operates a power source operation part, which is not illustrated, to turn ON the power source of the copy machine 1.

Continuing, in Step ST102, the image data receiving part 720 receives image data read by the image reading device 300. The image data includes an image formation instruction that is an instruction to the image forming portion GK to form predetermined toner images on the respective photoreceptor drums 2*a*, 2*b*, 2*c* and 2*d*, image information related to a toner image, paper number information, and the like.

Then, in Step ST103, the image formation controller 730 receives image data output from the image data receiving part 720.

Next, in Step ST104, the image formation controller 730 outputs a signal instructing image formation to the image forming portion GK, and outputs a request signal requesting to the drive controller 710 to cause the drive portion 700 to rotationally drive.

Subsequently, in Step ST105, the position detection part 620 (detector 623) confirms whether it is being detected that the detection member 621 is in the retracted position.

In this case, the detection member 621 of the position detection part 620 is in a state in which pivotally moving from the initial position to the retracted position is restricted by contact with the restricting member 630, as shown in FIG. 8E; therefore, the position detection part 620 (detector 623) does not detect that the detection member 621 is at the retracted position.

The drive controller 710 thereby does not permit the drive portion 700 to rotationally drive the paper feed roller 66.

Therefore, the paper T is not forcibly fed to the manual paper feed path La inside of the apparatus main body M through the paper supply feed path 640, and thus a malfunction such as a severe paper jam from paper T being fed while one has forgotten to mount the pad unit 610 is suppressed from occurring.

Then, in this case (Step ST105, NO), the processing is returned to before Step ST104. Herein, it may be configured so as to notify by way of a notification unit (not illustrated) that the pad unit 610 is not installed, in a case of the processing returning to Step ST104 being repeated a predetermined number of times.

A user having received the determination results of Step ST105 (NO) and having realized having forgotten to mount the pad unit 610 installs the pad unit 610 to the mounting part 602. When the pad unit 610 is installed to a predetermined mounting part 602, the restricting member 630 is moved to the restriction release position, as shown in FIG. 8A. According to this, the detection member 621 of the position detection part 620 enters a state in which pivotal movement from the initial position to the retracted position is allowed.

When the leading end of the paper T placed on the placement surface of the manual paper feed tray 65 abuts the detection member 621 and is made to move so as to abut and press the detection member 621 in this state, the detection member 621 is pivotally moved from the initial position to the retracted position.

The position detection part 620 (detector 623) thereby detects that the detection member 621 is at the retracted position (Step ST105, YES). Then, the processing advances to Step ST106.

Subsequently, in Step ST106, the drive controller 710 permits the drive portion 700 to rotationally drive the paper feed roller 66 (similarly permits ascending and descending driving of the lift drive portion (not illustrated)); therefore, the paper T (is transferred from the feed setup position to the feed position) is fed to the paper supply feed path 640 in a state in which double feeding is suppressed by being inserted between the paper feed roller 66 and the separation pad member 612 of the pad unit 610, and is fed to the manual paper feed path La inside of the apparatus main body M.

The paper T fed in the manual paper feed path La is fed to the resist roller pair 80 via the first junction P1 and the first paper feed path L1. From then on, image formation operations (printing) similar to those previously described are performed.

Next, in Step ST107, the image formation controller confirms whether image formation operations (printing) of a predetermined number of sheets of paper received from the image data receiving part 720 have completed. The image formation controller continues the processing in a case of not confirming that image formation operations of a predetermined number of sheets of paper has completed (NO), and ends the processing in a case of having confirmed that image formation operations of a predetermined number of sheets of paper has completed (YES).

The following effects are exerted according to the copy machine 1 of the present embodiment, for example.

The copy machine 1 of the present embodiment includes: the paper feed roller 66 that feeds the paper T placed on the manual paper feed tray 65 to inside of the apparatus main body M; the paper supply feed path 640 for paper T; the pad unit 610 that is disposed at a predetermined mounting part 602 so as to configure a portion of the paper feed supply path 640 and is detachable relative to the mounting part 602, is disposed to oppose the paper feed roller 66 further downstream in the feed direction in which the paper T is fed than the predetermined feed position, and has the separation pad members 612 disposed so as to sandwich, therebetween and the paper feed roller 66, the paper T; the position detection part 620 including the detection member 621 that is configured to be moveable between an initial position which is a position abutted to the leading end of the paper T moved, in a case of the paper T being moved from the predetermined position to the feed position or feed setup position, and a retracted position which is a position not abutted to the leading end of the topmost sheet of paper T, in a state disposed in the feed position, the switch part 622 that detects whether the detection member 621 is positioned at the retracted position, and detects that the paper T is disposed at the feed position or feed setup position in a case of having detected that the detection member 621 is at the retracted position; and the restricting member 630 that is disposed in the stored position opposing the detection member 621 to sandwich, therebetween and the detection member 621, the pad unit 610 in an installed state in which the pad unit 610 is installed to the mounting part 602, and is disposed at a restricting position that restricts the detection member 621 from moving from the initial position to the retracted position by abutting the detection member 621, in a detached state in which the pad unit 610 is detached from the mounting part 602.

As a result, in a state in which the pad unit 610 is detached from a predetermined mounting part 602 for replacement or repair, it is possible for the restricting member 630 to abut the detection member 621 and restrict movement of the detection member 621 from the initial position at which the leading end of the paper T is abutted to the retracted position at which the leading end of the paper T is not abutted. Therefore, it is possible to suppress a malfunction such as a severe paper jam from occurring accompanying the paper T being forcibly fed while one has forgotten to install the pad unit 610, by making it so that the feed of paper T by the rotational driving of the paper feed roller 66 does not occur in a case of having forgotten to mount the pad unit 610 detached for replacement or repair back to a predetermined mounting part 602 after the replacement or repair. In addition, the causes for failure of the image forming apparatus can also be drastically reduced.

Furthermore, in the present embodiment, the spring 632 is included that biases the restricting member 630 towards the restricting position, i.e. a position abutting the detection member 621 of the position detection part 620.

As a result, in a case of the pad unit 610 being detached from the mounting part 602, the restricting member 630 can be made to automatically move to the restricting position by the biasing force of the spring 632. Therefore, the labor in causing the restricting member 630 to move to the restricting position by hand after detachment of the pad unit 610 can be eliminated, and forgetting to move the restricting member 630 to the restricting position can be prevented. As a result, the occurrence of malfunctions such as a severe paper jam accompanying paper T being forcibly fed while one has forgotten to install the pad unit 610 can be much more reliably suppressed.

Furthermore, in the present embodiment, the copy machine 1 includes the drive portion 700 that causes the paper feed roller 66 to be rotationally driven, and the drive controller 710 that controls the drive portion 700. In addition, the drive control 710 is a controller that can permit the drive portion 700 to rotationally drive in a state in which the position detection part 620 detects that a sheet of paper T is disposed at a predetermined feed position or feed setup position, and does not permit the drive portion 700 to rotationally drive in a state in which the position detection part 620 does not detect that a sheet of paper T is disposed at the predetermined feed position or feed setup position. Then, in a case of the pad unit 610 being in a detached state, it is not detected by the position detection part 620 that a sheet of paper T is disposed at the feed position or feed setup position due to movement of the detection member 621 to the retracted position being restricted by the restricting member 630, and thus the drive controller 710 does not permit the drive portion 700 to rotationally drive.

As a result, it is possible to perform feed operation control of paper in that movement of the detection member 621 to the retracted position is not only mechanically restricted in a case of the pad unit 610 being in a state detached from the mounting part 602 as when forgetting installation of the pad unit 610, but also rotational driving of the drive portion 700 is not permitted based on the detection signal of the position detection part 620. Therefore, the feed mechanism 600 can reliably suppress forcible feeding of paper T when forgetting to install the pad unit 610 and the occurrence of malfunctions such as a severe paper jam accompanying this by mechanical (structural) restriction and control restriction.

Although a preferred embodiment of the present invention has been explained above, the present invention is not to be limited to the aforementioned embodiment, and various modifications thereto can be carried out.

For example, in the embodiment, the feed mechanism 600 is applied to the feed of the manual paper feed tray 65; however, it is not limited thereto. For example, the feed mechanism 600 may be applied to the feed of the paper feed cassette 52.

In addition, in the embodiment, it is configured such that both the detection member 621 of the position detection part 620 and the restricting member 630 move spatially by pivoting; however, they are not limited thereto. For example, the detection member 621 may be configured to be able to move between the initial position and the retracted position by sliding vertically, and the restricting member may be configured to be able to move between the restricting position and the restriction release position by sliding substantially horizontally.

In addition, in the embodiment, an explanation has been provided in which the separation pad member is given as an example of a separation member; however, it is not limited thereto. For example, the separation member may be a separation roller or the like. Furthermore, in the embodiment, an explanation has been similarly provided in which the pad unit is given as an example of a separation unit; however, it is not limited thereto. For example, the separation unit may be a separation roller unit having a separation roller.

In addition, in the embodiment, although an explanation has been provided in which the copy machine 1 is given as an example of an image forming apparatus, the image forming apparatus may be a monochromatic copy machine, a printer, a facsimile, a multifunctional machine with these functions, or the like.

Moreover, the image formation target material is not limited to paper, and may be a film sheet, for example.

What is claimed is:

1. An image forming apparatus, comprising:

an image forming portion;

a housing in which the image forming portion is disposed to be housed;

a placement portion on which a plurality of recording mediums can be placed;

a feed roller that is disposed to oppose an upper surface of the placement portion, and feeds a topmost one of the recording mediums on a predetermined feed position to inside of the housing;

a supply feed path in which the recording mediums are fed;

a separation unit including a separation member that is detachably disposed at a predetermined mounting part and that is disposed to oppose the feed roller on a more downstream side in a feed direction of the feed position, and is configured to form a nip with the feed roller and separate the recording mediums;

a position detection part configured to detect that a recording medium is disposed at a predetermined position on the placement portion, and the position detection part including:

a detection member that can move between an initial position that is a position where the detection member protrudes upward from the placement portion and a retracted position that is a position retracted from the placement portion in a state in which the recording medium is disposed at the predetermined position on the placement portion; and a restricting member that is disposed at a stored position in the mounting part opposing the detection member to interpose the separation unit between the detection member and the restricting member, in a mounted state in which the separation unit is mounted to the mounting part, and is disposed at a restricting position that restricts the detection member moving from the initial position to the retracted position by abutting the detection member, in a detached state in which the separation unit is detached from the mounting part.

2. An image forming apparatus according to claim 1, further comprising a biasing member that biases the restricting member so as to move towards the restricting position.

3. An image forming apparatus according to claim 1, wherein the detection member is disposed so as to block a portion of the supply feed path in the initial position, and is disposed so as not to block the supply feed path in the retracted position, and wherein the restricting member maintains a position of the detection member at a position such that a portion of the supply feed path is blocked thereby when the separation unit is in the detached state.

4. An image forming apparatus according to claim 1, further comprising:

a drive portion that rotationally drives the feed roller; and a drive controller configured to permit the drive portion to rotationally drive in a state in which the position detection part detects that the recording medium is disposed at the feed position or a feed setup position, and not to permit the drive portion to rotationally drive in a state in which the position detection part does not detect that the recording medium is disposed at the feed position or the feed setup position, and wherein, in a case of the separation unit being in the detached state, the position detection part does not detect that the recording medium is disposed at the feed position or the feed setup position due to movement of the detection member to the retracted position being restricted by the restricting member, and the drive controller does not permit the drive portion to rotationally drive.

5. A feed mechanism, comprising:

a placement portion on which a plurality of sheet materials can be placed;

a feed roller that is disposed to oppose an upper surface of the placement portion, and feeds a topmost one of the sheet materials in a predetermined feed direction;

a supply feed path in which the sheet materials are fed;

a separation unit including a separation member that is detachably disposed at a predetermined mounting part and that is disposed to oppose the feed roller on a more downstream side in a feed direction of the feed position, and is configured to form a nip with the feed roller and separate the sheet materials;

a detection member configured to detect that a sheet material is disposed on the placement portion, and to move between an initial position that is a position where the detection member protrudes upward from the placement portion and a retracted position retracted from the placement portion, in a state in which the sheet material is disposed on the placement portion; and a restricting member that is disposed at a stored position in the mounting part opposing the detection member to interpose the separation unit between the detection member and the restricting member in a mounted state in which the separation unit is mounted to the mounting part, and is disposed at a restricting position that restricts the detection member moving from the initial position to the retracted position by abutting the detection member, in a detached state in which the separation unit is detached from the mounting part.

6. A feed mechanism according to claim 5, further comprising a biasing member that biases the restricting member so as to move towards the restricting position.

7. A feed mechanism according to claim 5, wherein the detection member is disposed so as to block a portion of the supply feed path in the initial position, and is disposed so as not to block the supply feed path in the retracted position, and wherein the restricting member maintains a position of the detection member at a position such that a portion of the supply feed path is blocked thereby when the separation unit is in the detached state.

8. An image forming apparatus, comprising:

an image forming portion;

a housing in which the image forming portion is disposed to be housed;

a placement portion on which a plurality of recording mediums can be placed;

a feed roller that is disposed to oppose an upper surface of the placement portion, and feeds a topmost one of the recording mediums on a predetermined feed position to inside of the housing;

a supply feed path in which the recording mediums are fed;

a separation unit including a separation member that is detachably disposed at a predetermined mounting part and that is disposed to oppose the feed roller on a more downstream side in a feed direction of the feed position, and is configured to form a nip with the feed roller and separate the recording mediums;

a position detection part configured to detect that a recording medium is disposed at a predetermined position on the placement portion, and the position detecting part including:

a detection member that can move between an initial position that is a position where the detection member protrudes upward from the placement portion and a retracted position retracted from the placement portion in a state in which the recording medium is disposed at the predetermined position on the placement portion, and a detecting part configured to detect that the detection member is at the retracted position; and a restricting member that is disposed at a stored position in the mounting part opposing the detection member to interpose the separation unit between the detection member and the restricting member, in a mounted state in which the separation unit is mounted to the mounting part, and is disposed at a restricting position that restricts the detection member moving from the initial position to the retracted position by abutting the detection member, in a detached state in which the separation unit is detached from the mounting part.

9. An image forming apparatus according to claim 8, further comprising a biasing member that biases the restricting member so as to move towards the restricting position.

10. An image forming apparatus according to claim 8, wherein the detection member is disposed so as to block a portion of the supply feed path in the initial position, and is disposed so as not to block the supply feed path in the retracted position, and wherein the restricting member maintains a position of the detection member at a position such that a portion of the supply feed path is blocked thereby when the separation unit is in the detached state.

11. An image forming apparatus according to claim 8, further comprising:

a drive portion that rotationally drives the feed roller; and a drive controller configured to permit the drive portion to rotationally drive in a state in which the position detection part detects that the detection member is at the retracted position, and not to permit the drive portion to rotationally drive in a state in which the position detection part does not detect that the detection member is at the retracted position, and wherein, in a case of the separation unit being in the detached state, the position detection part does not detect that the detection member is disposed at the retracted position due to movement of the detection member to the retracted position being restricted by the restricting member, and the drive controller does not permit the drive portion to rotationally drive.

* * * * *